US005147576A

United States Patent [19]

Montague et al.

[11] Patent Number: 5,147,576

[45] Date of Patent: Sep. 15, 1992

[54] LIQUID DETERGENT COMPOSITION IN THE FORM OF LAMELLAR DROPLETS CONTAINING A DEFLOCCULATING POLYMER

[75] Inventors: Peter G. Montague, Dunchurch, Great Britain; Johannes C. Van de Pas, Vlaardingen, Netherlands

[73] Assignee: Lever Brothers Company, Division of Conopco, Inc., New York, N.Y.

[21] Appl. No.: 689,124

[22] Filed: Apr. 22, 1991

Related U.S. Application Data

[63] Continuation of Ser. No. 365,080, Jun. 12, 1989, abandoned.

[30] Foreign Application Priority Data

Jun. 13, 1988 [GB] United Kingdom ..... 8813978

[51] Int. Cl.[5] ..... C11D 3/37; C11D 10/02; C11D 17/00

[52] U.S. Cl. ..... 252/174; 252/173; 252/174.15; 252/174.17; 252/174.18; 252/174.21; 252/174.23; 252/174.24; 252/DIG. 2; 252/DIG. 14; 252/174.19

[58] Field of Search ..... 252/135, 173, 174.23, 252/174.24, 174.17, 174.18, DIG. 14, 174.21, 174, DIG. 2

[56] References Cited

U.S. PATENT DOCUMENTS

| | | | |
|---|---|---|---|
| 3,060,124 | 10/1962 | Ginn | 252/135 |
| 3,156,655 | 11/1964 | Bright | 252/109 |
| 3,208,949 | 9/1965 | Rosnati | 252/109 |
| 3,210,285 | 10/1965 | Gangswisch | 252/526 |
| 3,210,286 | 10/1965 | Gangswisch | 252/526 |
| 3,235,505 | 2/1966 | Tuvell | 252/135 |
| 3,328,309 | 6/1967 | Grifo | 252/135 |
| 3,457,176 | 7/1969 | Huggins | 252/135 |
| 3,520,818 | 7/1970 | Cambre | 252/113 |
| 3,522,186 | 7/1970 | Cambre | 252/112 |
| 3,579,456 | 5/1971 | Cambre | 252/115 |
| 3,657,175 | 4/1972 | Zimmerman | 524/96 |
| 3,719,647 | 3/1973 | Hardy et al. | 252/112 |
| 3,813,349 | 5/1978 | Wolfson | 252/526 |
| 4,079,028 | 3/1978 | Emmons et al. | 524/507 |
| 4,082,684 | 4/1978 | Kreischer | 252/109 |
| 4,339,371 | 6/1982 | Robinson | 524/310 |
| 4,421,902 | 12/1983 | Chang et al. | 526/317 |
| 4,423,199 | 12/1983 | Chang et al. | 526/307.6 |
| 4,429,097 | 1/1987 | Chang et al. | 526/317 |
| 4,438,015 | 3/1987 | Huber | 252/174.24 |
| 4,514,552 | 4/1985 | Shay et al. | 526/301 |
| 4,524,175 | 6/1985 | Stanley | 524/831 |
| 4,556,504 | 12/1985 | Rex | 252/135 |
| 4,734,221 | 3/1988 | Edwards et al. | 252/544 |
| 4,869,842 | 9/1989 | Denis et al. | 252/121 |
| 4,871,467 | 10/1989 | Akred et al. | 252/135 |

FOREIGN PATENT DOCUMENTS

| | | |
|---|---|---|
| 7714 | 2/1980 | European Pat. Off. . |
| 13836 | 8/1980 | European Pat. Off. . |
| 57875 | 8/1982 | European Pat. Off. . |
| 63018 | 10/1982 | European Pat. Off. . |
| 126528 | 11/1984 | European Pat. Off. . |
| 171429 | 5/1985 | European Pat. Off. . |
| 172025 | 2/1986 | European Pat. Off. . |
| 190892 | 8/1986 | European Pat. Off. . |
| 197635 | 10/1986 | European Pat. Off. . |
| 215565 | 3/1987 | European Pat. Off. . |
| 248612 | 12/1987 | European Pat. Off. . |
| 196398 | 11/1984 | Japan . |
| 1068554 | 5/1967 | United Kingdom . |
| 1302543 | 1/1973 | United Kingdom . |
| 1482515 | 8/1977 | United Kingdom . |
| 1506427 | 4/1978 | United Kingdom . |
| 2043646 | 10/1980 | United Kingdom . |
| 1589971 | 5/1981 | United Kingdom . |

OTHER PUBLICATIONS

Angewandte Chemie, vol. 27, No. 1, Jan. 1988, pp. 113–158.

*Primary Examiner*—A. Lionel Clingman
*Assistant Examiner*—E. Higgins
*Attorney, Agent, or Firm*—Ronald A. Koatz

[57] ABSTRACT

Greater flexibility in selecting components for stable aqueous dispersions of surfactant lamellar droplets, and improved possibilities for formulating concentrated forms of such dispersions are provided by incorporating in the composition, a deflocculating polymer having a hydrophilic backbone and at least one hydrophobic side-chain.

15 Claims, 1 Drawing Sheet

Figure 1:
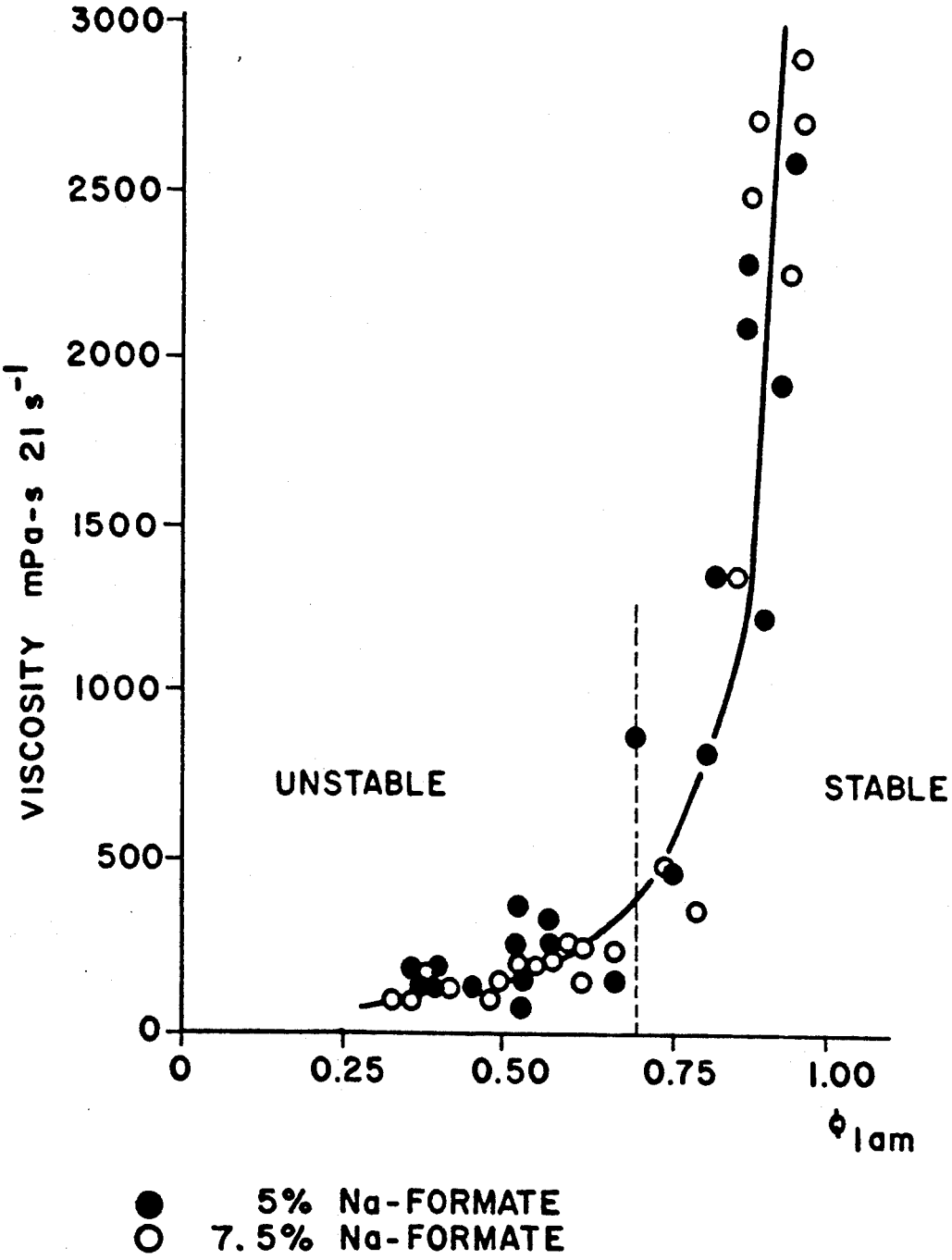

LIQUID DETERGENT COMPOSITION IN THE FORM OF LAMELLAR DROPLETS CONTAINING A DEFLOCCULATING POLYMER

This is a continuation application of Ser. No. 07/365,080, filed Jun. 12, 1989, now abandoned.

The present invention is concerned with aqueous liquid detergent compositions which contain sufficient detergent-active material and, optionally, sufficiently dissolved electrolyte to result in a structure of lamellar droplets dispersed in a continuous aqueous phase.

Lamellar droplets are a particular class of surfactant structures which, inter alia, are already known from a variety of references, e.g. H. A. Barnes, 'Detergents', Ch.2. in K. Walters (Ed), 'Rheometry: Industrial Applications', J. Wiley & Sons, Letchworth 1980.

Such lamellar dispersions are used to endow properties such as consumer-preferred flow behaviour and/or turbid appearance. Many are also capable of suspending particulate solids such as detergency builders or abrasive particles. Examples of such structured liquids without suspended solids are given in U.S. Pat. No. 4,244,840, whilst examples where solid particles are suspended are disclosed in specifications EP-A-160 342; EP-A-38 101; EP-A-104 452 and also in the aforementioned U.S. Pat. No. 4,244,840. Others are disclosed in European Patent Specification EP-A-151 884, where the lamellar droplet are called 'spherulites'.

The presence of lamellar droplets in a liquid detergent product may be detected by means known to those skilled in the art, for example optical techniques, various rheometrical measurements. X-ray or neutron diffraction, and electron microscopy.

The droplets consist of an onion-like configuration of concentric bi-layers of surfactant molecules, between which is trapped water or electrolyte solution (aqueous phase). Systems in which such droplets are close-packed provide a very desirable combination of physical stability and solid-suspending properties with useful flow properties.

The viscosity and stability of the product depend on the volume fraction of the liquid which is occupied by the droplets. Generally speaking, the higher the volume fraction of the dispersed lamellar phase (droplets), the better the stability. However, higher volume fractions also lead to increased viscosity which in the limit can result in an unpourable product. This results in a compromise being reached. When the volume fraction is around 0.6, or higher, the droplets are just touching (space-filling). This allows reasonable stability with an acceptable viscosity (say no more than 2.5 Pas, preferably no more than 1 Pas at a shear rate of $21s^{-1}$). This volume fraction also endows useful solid-suspending properties. Conductivity measurements are known to provide a useful way of measuring the volume fraction, when compared with the conductivity of the continuous phase.

FIG. 1 shows a plot of viscosity against lamellar phase volume fraction for a typical composition of known kind:

| | wt. % |
|---|---|
| Surfactants* | 20 |
| Na-formate | 5 or 7.5 |
| Na-citrate 2aq | 10 |
| Borax | 3.5 |

-continued

| | wt. % |
|---|---|
| Tinopal CBS-X | 0.1 |
| Perfume | 0.15 |
| Water | balance |

*NaDoBS/LES/Neodol 23-6.5. See Table 3 in Examples for raw material specifications.

It will be seen that there is a window bounded by lower volume fraction of 0.7 corresponding to the onset of instability and an upper volume fraction of 0.83 or 0.9 corresponding to a viscosity of 1 Pas or 2 Pas, respectively. This is only one such pilot and in many cases the lower volume fraction can be 0.6 or slightly lower.

A complicating factor in the relationship between stability and viscosity on the one hand and, on the other, the volume fraction of the lamellar droplets is the degree of flocculation of the droplets. When flocculation occurs between the lamellar droplets at a given volume fraction, the viscosity of the corresponding product will increase owing to the formation of a network throughout the liquid. Flocculation may also lead to instability because deformation of the lamellar droplets, owing to flocculation, will make their packing more efficient. Consequently, more lamellar droplets will be required for stabilization by the space-filling mechanism, which will again lead to a further increase of the viscosity.

The volume fraction of droplets is increased by increasing the surfactant concentration and flocculation between the lamellar droplets occurs when a certain threshold value of the electrolyte concentration is crossed at a given level of surfactant (and fixed ratio between any different surfactant components). Thus, in practice, the effects referred to above mean that there is a limit to the amounts of surfactant and electrolyte which can be incorporated whilst still having an acceptable product. In principle, higher surfactant levels are required for increased detergency (cleaning performance). Increased electrolyte levels can also be used for better detergency, or are sometimes sought for secondary benefits such as building.

We have now found that the dependency of stability and/or viscosity upon volume fraction can be favourably influenced by incorporating a deflocculating polymer comprising a hydrophilic backbone and one or more hydrophobic side-chains.

The deflocculating polymer allows, if desired, the incorporation of greater amounts of surfactants and/or electrolytes than would otherwise be compatible with the need for a stable, low-viscosity product. It also allows (if desired) incorporation of greater amounts of certain other ingredients to which, hitherto, lamellar dispersions have been highly stability-sensitive. Further details of these are given hereinbelow.

The present invention allows formulation of stable, pourable products wherein the volume fraction of the lamellar phase is 0.5, 0.6 or higher, but with combinations or concentrations of ingredients not possible hitherto.

The volume fraction of the lamellar droplet phase may be determined by the following method. The composition is centrifuged, say at 40,000 G for 12 hours, to separate the composition into a clear (continuous aqueous) layer, a turbid active-rich (lamellar) layer and (if solids are suspended) a solid particle layer. The conductivity of the continuous aqueous phase, the lamellar phase and of the total composition before centrifugation are measured. From these, the volume fraction of the lamellar phase is calculated, using the Bruggeman equation, as disclosed in American Physics, 24, 636 (1935). When applying the equation, the conductivity of the total composition must be corrected for the conductivity inhibition owing to any suspended solids present. The degree of correction necessary can be determined by measuring the conductivity of a model system. This has the formulation of the total composition but without any surfactant. The difference in conductivity of the model system, when continuously stirred (to disperse the solids) and at rest (so the solids settle), indicates the effect of suspended solids in the real composition. Alternatively, the real composition may be subjected to mild centrifugation (say 2,000 G for 1 hour) to just remove the solids. The conductivity of the upper layer is that of the suspending base (aqueous continuous phase with dispersed lamellar phase, minus solids).

It should be noted that, if the centrifugation at 40,000 G fails to yield a separate continuous phase, the conductivity of the aforementioned model system at rest can serve as the conductivity of the continuous aqueous phase. For the conductivity of the lamellar phase, a value of 0.8 can be used, which is typical for most systems. In any event, the contribution of this term in the equation is often negligible.

Preferably, the viscosity of the aqueous continuous phase is less than 25 mPas, most preferably less than 15 mPas, especially less than 10 mPas, these viscosities being measured using a capillary viscometer, for example an Ostwald viscometer.

Sometimes, it is preferred for the compositions of the present invention to have solid-suspending properties (i.e. capable of suspending solid particles). Therefore, in many preferred examples, suspended solids are present. However, sometimes it may also be preferred that the compositions of the present invention do not have solid suspending properties, this is also illustrated in the examples.

In practical terms, i.e. as determining product properties, the term 'deflocculating' in respect of the polymer means that the equivalent composition, minus the polymer, has a significantly higher viscosity and/or becomes unstable. It is not intended to embrace polymers which would both increase the viscosity and not enhance the stability of the composition. It is also not intended to embrace polymers which would lower the viscosity simply by a dilution effect, i.e. only by adding to the volume of the continuous phase. Nor does it include those polymers which lower viscosity only by reducing the volume fraction (shrinking) of the lamellar droplets, as disclosed in our European patent application EP 301 883. Thus, although within the ambit of the present invention, relatively high levels of the deflocculating polymers can be used in those systems where a viscosity reduction is brought about; typically levels as low as from about 0.01% by weight to about 1.0% by weight can be capable of reducing the viscosity at 21 $s^{-1}$ by up to 2 orders of magnitude.

Especially preferred embodiments of the present invention exhibit less phase separation on storage and have a lower viscosity than an equivalent composition without any of the deflocculating polymer.

Without being bound by any particular interpretation or theory, the applicants have hypothesized that the polymers exert their action on the composition by the following mechanism. The hydrophobic side-chain(s) could be incorporated only in the outer bi-layer of the droplets, leaving the hydrophilic backbone over the outside of the droplets and additionally the polymers could also be incorporated deeper inside the droplet.

When the hydrophobic side chains are only incorporated in the outer bilayer of the droplets, this has the effect of decoupling the inter- and intra-droplet forces i.e. the difference between the forces between individual surfactant molecules in adjacent layers within a particular droplet and those between surfactant molecules in adjacent droplets could become accentuated in that the forces between adjacent droplets are reduced. This will generally result in an increased stability due to less flocculation and a decrease in viscosity due to smaller forces between the droplets resulting in greater distances between adjacent droplets.

When the polymers are incorporated deeper inside the droplets also less flocculation will occur, resulting in an increase in stability. The influence of these polymers within the droplets on the viscosity is governed by two opposite effects: firstly the presence of deflocculating polymers will decrease the forces between adjacent droplets, resulting in greater distances between the droplets, generally resulting in a lower viscosity of the system; secondly the forces between the layers within the droplets are equally reduced by the presence of the polymers in the droplet, this generally results in an increase in the water layer thickness, therewith increasing the lamellar volume of the droplets, therewith increasing the viscosity. The net effect of these two opposite effects may result in either a decrease or an increase in the viscosity of the product.

It is conventional in patent specifications relating to aqueous structured liquid detergents to define the stability of the composition in terms of the volume separation observed during storage for a predetermined period at a fixed temperature. In fact, this can be an over-simplistic definition of what is observed in practice. Thus, it is appropriate here to give a more detailed description.

For lamellar droplet dispersions, where the volume fraction of the lamellar phase is below 0.6 and the droplets are flocculated, instability is inevitable and is observed as a gross phase separation occurring in a relatively short time. When the volume fraction is below 0.6 but the droplets are not flocculated, the composition may be stable or unstable. When it is unstable, a phase separation occurs at a slower rate than in the flocculated case and the degree of phase separation is less.

When the volume fraction of the lamellar phase is below 0.6, whether the droplets are flocculated or not, it is possible to define stability in the conventional manner. In the context of the present invention, stability for these systems can be defined in terms of the maximum separation compatible with most manufacturing and retail requirements. That is, the 'stable' compositions will yield no more than 2% by volume phase separation as evidenced by appearance of 2 or more separate layers when stored at 25° C. for 21 days from the time of preparation.

In the case of the compositions where the lamellar phase volume fraction is 0.6 or greater, it is not always easy to apply this definition. In the case of the present invention, such systems may be stable or unstable, according to whether or not the droplets are flocculated. For those that are unstable, i.e. flocculated, the degree of phase separation may be relatively small, e.g. as for the unstable non-flocculated systems with the lower volume fraction. However, in this case the phase separation will often not manifest itself by the appearance of a distinct layer of continuous phase but will appear distributed as 'cracks' throughout the product. The onset of these cracks appearing and the volume of the material they contain are almost impossible to measure to a very high degree of accuracy. However, those skilled in the art will be able to ascertain instability because the presence of a distributed separate phase greater than 2% by volume of the total composition will readily be visually identifiable by such persons. Thus, in formal terms, the above-mentioned definition of 'stable' is also applicable in these situations, but disregarding the requirement for the phase separation to appear as separate layers.

Especially preferred embodiments of the present invention yield less than 0.1% by volume visible phase separation after storage at 25° C. for 90 days from the time of preparation.

It must also be realized that there can be some difficulty in determining the viscosity of an unstable liquid.

When the volume fraction of the lamellar phase is less than 0.6 and the system is deflocculated or when the volume fraction is 0.6 or greater and the system is flocculated, then phase separation occurs relatively slowly and meaningful viscosity measurement can usually be determined quite readily. For all compositions of the present invention it is usually preferred that their viscosity is not greater than 2.5 Pas, most preferably no more than 1.0 Pas, and especially not greater than 750 mPas at a shear rate of $21s^{-1}$.

When the volume fraction of the lamellar phase is less than 0.6 and the droplets are flocculated, then often the rapid phase separation occurring makes a precise determination of viscosity rather difficult. However, it is usually possible to obtain a figure which, whilst approxiate, is still sufficient to indicate the effect of the deflocculating polymer in the compositions according to the present invention. Where this difficulty arises in the compositions exemplified hereinbelow, it is indicated accordingly.

The compositions according to the invention may contain only one, or a mixture of deflocculating polymer types. The term 'polymer types' is used because, in practice, nearly all polymer samples will have a spectrum of structures and molecular weights and often impurities. Thus, any structure of deflocculation polymers decribes in this specification refers to polymers which are believed to be effective for deflocculation purposes as defined hereabove. In practice these effective polymers may constitute only part of the polymer sample, provided that the amount of deflocculation polymer in total is sufficient to effect the desired deflocculation effects. Furthermore, any structure described herein for an individual polymer type, refers to the structure of the predominating deflocculating polymer species and the molecular weight specified is the weight average molecular weight of the deflocculation polymers in the polymer mixture.

The hydrophilic backbone of the polymer generally is a linear, branched or lightly crosslinked molecular composition containing one or more types of relatively hydrophilic monomer units. Preferably the hydrophilic monomers are sufficiently water soluble to form at least a 1% by weight solution when dissolved in water. The only limitations to the structure of the hydrophilic backbone are that the polymer must be suitable for incorporation in an active-structured aqueous liquid detergent composition and that a polymer corresponding to the hydrophilic backbone made from the backbone monomeric constituents is relatively soluble in water, in that the solubility in water at ambient temperature and at a pH of 3.0 to 12.5 is preferably more than 1 g/l, more preferred more than 5 g/l, most preferred more than 10 g/l.

Preferably the hydrophilic backbone is predominantly linear; more preferably the main chain of the backbone constitutes at least 50% by weight, preferably more than 75%, most preferred more than 90% by weight of the backbone.

The hydrophilic backbone is composed of monomer units, which can be selected from a variety of units available for the preparation of polymers. The polymers can be linked by any possible chemical link, although the following types of linkages are preferred:

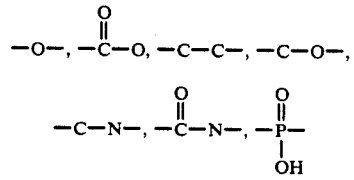

Examples of types of monomer units are:

(i) Unsaturated $C_{1-6}$ acids, ethers, alcohols, aldehydes, ketones, or esters. Preferably these monomer units are mono-unsaturated. Examples of suitable monomers are acrylic acid, methacrylic acid, maleic acid, crotonic acid, itaconic acid, aconitic acid, citraconic acid, vinyl-methyl ether, vinyl sulphonate, vinylalcohol obtained by the hydrolysis of vinyl acetate, acrolein, allyl alcohol and vinyl acetic acid.

(ii) Cyclic units, either being unsaturated or comprising other groups capable of forming inter-monomer linkages. In linking these monomers the ring-structure of the monomers may either be kept intact, or the ring structure may be disrupted to form the backbone structure. Examples of cyclic monomer units are sugar units, for instance saccharides and glucosides; alkoxy units such as ethylene oxide and hydroxy propylene oxide; and maleic anhydride.

(iii) Other units, for example glycerol or other saturated polyalcohols.

Each of the above mentioned monomer units may be substituted with groups such as amino, amine, amide, sulphonate, sulphate, phosphonate, phosphate, hydroxy, carboxyl and oxide groups.

The hydrophilic backbone of the polymer is preferably composed of one or two monomer types but also possible is the use of three or more different monomer types in one hydrophilic backbone. Examples of preferred hydrophilic backbones are: homopolymers of acrylic acid, copolymers of acrylic acid and maleic acid, poly 2-hydroxy ethyl acrylate, polysaccharides, cellulose ethers, polyglycerols, polyacrylamides, polyvinylalcohol/polyvinylether copolymers, poly sodium vinyl sulphonate, poly 2-sulphato ethyl methacrylate, polyacrylamido methyl propane sulphonate and copolymers of acrylic acid and tri methyl propane triacrylate.

Optionally the hydrophilic backbone may contain small amounts of relatively hydrophobic units, e.g. those derived from polymers having a solubility of less than 1 g/l in water, provided that the overall solubility of the hydrophilic polymer backbone still satisfies the solubility requirements as specified hereabove. Examples of relatively water insoluble polymers are polyvinyl acetate, polymethyl methacrylate, polyethyl acrylate, polyethylene, polypropylene, polystyrene, polybutylene oxide, propylene oxide and polyhydroxy propyl acetate.

Preferably the hydrophobic side chains are part of a monomer unit which is incorporated in the polymer by copolymerising hydrophobic monomers and the hydrophilic monomers making up the backbone of the polymer. The hydrophobic side chains for this use preferably include those which when isolated from their linkage are relatively water insoluble, i.e. preferably less than 1 g/l more preferred less than 0.5 g/l, most preferred less than 0.1 g/l of the hydrophobic monomers, will dissolve in water at ambient temperature and a pH of 3.0 to 12.5.

Preferably the hydrophobic moieties are selected from siloxanes, saturated and unsaturated alkyl chains, e.g. having from 5 to 24 carbon atoms, preferably from 6 to 18, most preferred from 8 to 16 carbon atoms, and are optionally bonded to the hydrophilic backbone via an alkoxylene or polyalkoxylene linkage, for example a polyethoxy, polypropoxy or butyloxy (or mixtures of same) linkage having from 1 to 50 alkoxylene groups. Alternatively the hydrophobic side chain may be composed of relatively hydrophobic alkoxy groups, for example butylene oxide and/or propylene oxide, in the absence of alkyl or alkenyl groups. In some forms, the side-chain(s) will essentially have the character of a nonionic surfactant.

In this context it can be noted that UK patent specifications GB 1 506 427 A and GB 1 589 971 A disclose aqueous compositions including a carboxylate polymer partly esterified with nonionic surface side-chains. The compositions according to these references are hereby disclaimed from the scope of the present invention. The particular polymer described there (a partially esterified, neutralized co-polymer of maleic anhydride with vinylmethyl ether, ethylene or styrene, present at from 0.1 to 2% by weight of the total composition) was not only difficult to make, but found only to work for a very narrow concentration range of five separate ingredients, said all to be essential for stability. The particular products are very alkaline (pH 12.5). In contrast, the present invention provides a broad class of readily preparable polymers, usable in a wide range of detergent lamellar droplet aqueous dispersions.

Thus, one aspect of the present invention provides a liquid detergent composition comprising a dispersion of lamellar droplets in an aqueous continuous phase, the composition having a pH less than 12.5 and yielding no more than 2% by volume phase separation when stored at 25° C. for 21 days from the time of separation, and further comprising a deflocculating polymer having a hydrophilic backbone and at least one hydrophobic side-chain.

Preferably though, all compositions according to the present invention have a pH less than 11, most preferably less than 10.

U.S. Pat. Nos. 3,235,505, 3,328,309 and 3,457,176 describe the use of polymers having relatively hydrophilic backbones and relatively hydrophobic side-chains as stabilizers for emulsions. However, these products are unstable according to the definition of stability hereinbefore.

Another aspect of the present invention provides a liquid detergent composition which yields no more than 2% by volume phase separation when stored at 25° C. for 21 days from the time of preparation and comprises a dispersion of lamellar droplets in an aqueous continuous phase and also comprises a deflocculating polymer having a hydrophilic backbone and at least one hydrophobic side-chain, with the proviso that when the composition comprises from 3% to 12% of a potassium alkyl benzene sulphonate, from 2% to 8% of a potassium fatty acid soap, from 0.5 to 5% of a nonionic surfactant, and from 1 to 25% of sodium tripolyphosphate and/or tetrapotassium pyrophosphate, all percentages being by weight, the weight ratio of said sulphonate to said soap being from 1:2 to 6:1, the weight ratio of said sulphonate to said nonionic surfactant being from 3:5 to 25:1, and the total amount of said sulphonate, soap and nonionic surfactant being from 7.5 to 20% by weight, then the decoupling polymer does not consist solely of from 0.1 to 2% by weight of a partially esterified, neutralized co-polymer of maleic anhydride with vinylmethyl ether, ethylene or styrene.

Preferably, the deflocculating polymer has a lower specific viscosity than those disclosed in GB 1 506 427 A and GB 1 589 971 A, i.e. a specific viscosity less than 0.1 measured as lg in 100 ml of methylethylketone at 25° C. Specific viscosity is a dimensionless viscosity-related property which is independent of shear rate and is well known in the art of polymer science.

Some polymers having a hydrophilic backbone and hydrophobic side-chains are known for thickening isotropic aqueous liquid detergents, for example from European Patent Specification EP-A-244 006. However, there is no suggestion in such references that polymers of this general type are usable as stabilizers and/or viscosity-reducing agents in (anisotropic) lamellar droplet dispersions.

In the compositions of the present invention, it is possible to use deflocculating polymers wherein the backbone of the polymer is of anionic, cationic, nonionic, zwitterionic or amphoteric nature. Possibly the polymer backbones have a structure generally corresponding to a surfactant structure, and independently of whether or not the backbone has such as form, the side-chain(s) may also have structures generally corresponding to anionic, cationic, zwitterionic or amphoteric surfactants. The only restriction is that the side-chain(s) should have hydrophobic character, relative to the polymer backbone. However, the choice of overall polymer types will usually be limited by the surfactants in the composition. For example, polymers with any cationic surfactant structural features would be less preferred in combination with anionic surfactants, and vice versa.

One preferred class of polymers for use in the compositions of the present invention comprises those of general formula (I)

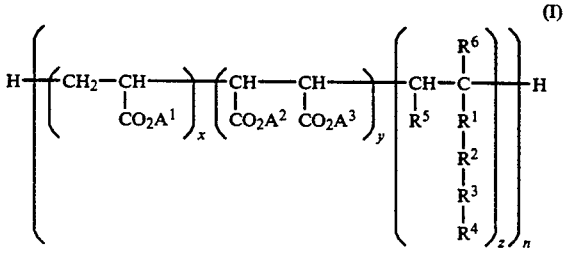

(I)

wherein:

z is 1; (x+y): z is from 4:1 to 1,000:1, preferably from 6:1 to 250:1; in which the monomer units may be in random order; y preferably being from 0 up to a maximum equal to the value of x; and n is at least 1;

$R^1$ represents —CO—O—, —O—, —O—CO—, —$CH_2$—, —CO—NH— or is absent;

$R^2$ represents from 1 to 50 independently selected alkyleneoxy groups preferably ethylene oxide or propylene oxide groups, or is absent, provided that when $R^3$ is absent and $R^4$ represents hydrogen or contains no more than 4 carbon atoms, then $R^2$ must contain an alkyleneoxy group with at least 3 carbon atoms;

$R^3$ represents a phenylene linkage, or is absent;

$R^4$ represents hydrogen or a $C_{1-24}$ alkyl or $C_{2-24}$ alkenyl group, with the provisos that a) when $R^1$ represents —O—CO—, $R^2$ and $R^3$ must be absent and $R^4$ must contain at least 5 carbon atoms;

b) when $R^2$ is absent, $R^4$ is not hydrogen and when $R^3$ is absent, then $R^4$ must contain at least 5 carbon atoms;

$R^5$ represents hydrogen or a group of formula —$COOA^4$;

$R^6$ represents hydrogen or $C_{1-4}$ alkyl; and $A^1$, $A^2$, $A^3$ and $A^4$ are independently selected from hydrogen, alkali metals, alkaline earth metals, ammonium and amine bases and $C_{1-4}$.

Another class of polymers for use in compositions of the present invention comprise those of formula (II)

(II)

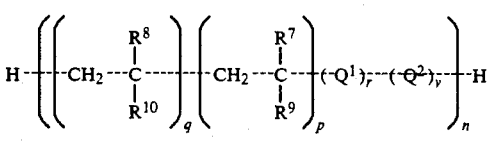

wherein:

$Q^2$ is a molecular entity of formula (IIa):

(IIa)

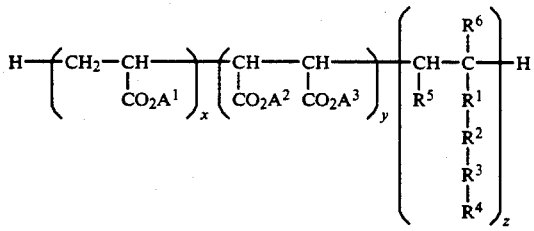

wherein z and $R^{1-6}$ are as defined for formula (I); $A^{1-4}$, are as defined for formula (I) or $(C_2H_4O)_tH$, wherein t is from 1-50, and wherein the monomer units may be in random order;

$Q^1$ is a multifunctional monomer, allowing the branching of the polymer, wherein the monomers of the polymer may be connected to $Q^1$ in any direction, in any order, therewith possibly resulting in a branched polymer. Preferably $Q^1$ is trimethyl propane triacrylate (TMPTA), methylene bisacrylamide or divinyl glycol.

n and z are as defined above; v is 1; and (x+y+p+q+r): z is from 4:1 to 1,000:1, preferably from 6:1 to 250:1; in which the monomer units may be in random order; and preferably either p and q are zero, or r is zero;

$R^7$ and $R^8$ represent —$CH_3$ or —H;

$R^9$ and $R^{10}$ represent substituent groups such as amino, amine, amide, sulphonate, sulphate, phophonate, phosphate, hydroxy, carboxyl and oxide groups, preferably they are selected from —$SO_3Na$, —CO—O—$C_2H_4$—$OSO_3Na$, —CO—O—N-H—$C(CH_3)_2$—$SO_3Na$, —CO—$NH_2$, —O—-CO—$CH_3$, —OH;

A third class of polymers for use in compositions of the present invention comprise those of formula (III):

(III)

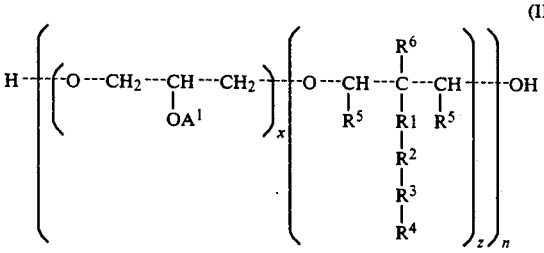

wherein:

x is from 4 to 1,000, preferably from 6 to 250; n is 1, z and $R^{1-6}$ are as defined in formula I, wherein the monomers units may be in random order;

$A^1$ is as defined above for formula I, or —CO—$CH_2$—$C(OH)CO_2A^1$—$CH_2$—$CO_2A^1$, or may be a branching point whereto other molecules of formula (III) are attached.

Examples of molecules of this formula are hydrophobically modified polyglycerol ethers or hydrophobically modified condensation polymers of polyglycerol and citric acid anhydride.

Other suitable materials have the formula (IV)

(IV)

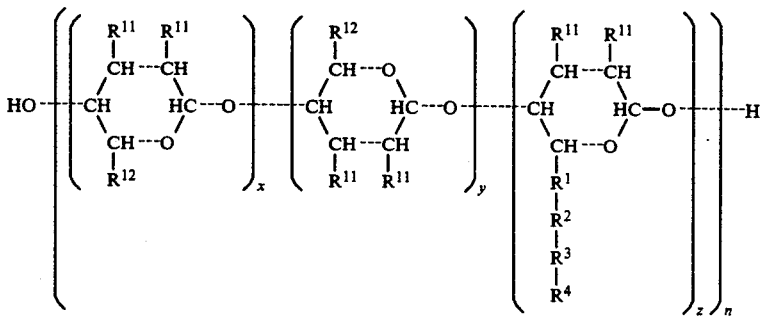

Wherein:

z, n and $A^1$ are as defined for formula I, (x+y):z is from 4:1 to 1,000 to 1, preferably from 6:1 to 250:1; wherein the monomer units may be in random order.

$R^1$ is as defined above for formula I, or can be —$CH_2$—O—, —$CH_2$—O—CO—, —NH—CO—;

$R^{2-4}$ are as defined in formula I;

$R^{11}$ represents —OH, —NH—CO—$CH_3$, —$SO_3A^1$ or —$OSO_3A^1$;

$R^{12}$ represents —OH, —$CH_2OH$, —$CH_2OSO_3A^1$, $COOA^1$, —$CH_2$—OCH3;

Examples of molecules of this formula are hydrophobically modified polydextran, -dextran sulphonates, and -dextran sulphates and the commercially available lipoheteropolysaccharides Emulsan or Biosan LP-31 (ex Petroferm).

Other suitable polymer materials have the following formula (V):

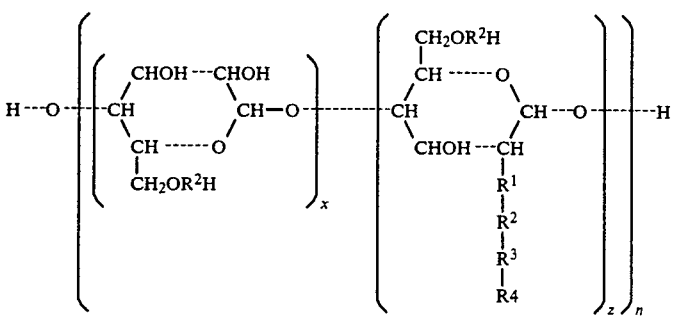

(V)

Wherein: z, n and $R^{1-6}$ are as defined above for formula I; and x is as defined for formula III;

Similar materials are disclosed in GB 2,043,646.

Other suitable polymers are hydrophobically modified condensation polymers of -hydroxy acids of formula (VI):

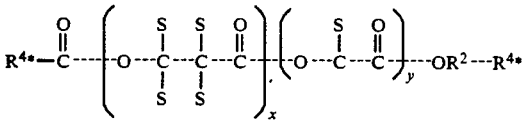

(VI)

wherein:

If z is the total of $R^4$ groups, then the ratio (x+y):z is from 4:1 to 1,000:1, preferably from 6:1 to 250:1; $R^{4*}$ is $R^4$ or —H;

$R^2$ and $R^4$ are as defined above for formula I; and

S is selected from —H, —$COOA^1$, —$CH_2COOA^1$, —$CH(COOA^1)_2$, (—$CH_2COOA^1)_2H$, wherein $A^1$ is as defined for formula I or is $R^4$;

with the proviso that at least one $R^4$ group is present as a side chain;

Examples of suitable polymer backbones are polymalate, polytartronate, polycitrate, polyglyconate; or mixtures thereof.

Other suitable polymers are hydrophobically modified polyacetals of formula (VII):

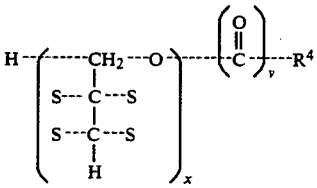

(VII)

Wherein:

x, z, S and $R^4$ are as defined above for formula VI;

and wherein at least one $R^4$ group is present as a side chain; and v is 0 or 1;

In any particular sample of polymer materials in which polymers of the above formulas are in the form of a salt, usually, some polymers will be full salts ($A^1$–$A^4$ all other than hydrogen), some will be full acids ($A^1$–$A^4$ all hydrogen) and some will be part-salts (one or more of $A^1$–$A^4$ hydrogen and one or more other than hydrogen).

The salts of the polymers of the above formulas may be formed with any organic or inorganic cation defined for $A^1$–$A^4$ and which is capable of forming a water-soluble salt with a low molecular weight carboxylic acid. Preferred are the alkali metal salts, especially of sodium or potassium.

The above general formulas are to be construed as including those mixed copolymer forms wherein, within a particular polymer molecule where n is 2 is greater, $R^1$–$R^{12}$ differ between individual monomer units therein.

One preferred sub-class comprises those polymers which contain substantially no maleic acid (or esterified form thereof) monomer units.

Although in the polymers of the above formulas and their salts, the only requirement is that n is at least 1, x (+y+p+q+r) is at least 4 and that they fulfil the definitions of the deflocculating effect hereinbefore described (stabilizing and/or viscosity lowering), it is helpful here to indicate some preferred molecular weights. This is preferable to indicating values of n. However, it must be realized that in practice there is no method of determining polymer molecular weights with 100% accuracy.

As already referred to above, only polymers of which the value of n is equal to or more than 1 are believed to be effective a deflocculating polymers. In practice however generally a mixture of polymers will be used. For the purpose of the present invention it is not necessary that the polymer mixtures as used have an average value of n which is equal or more than one; also polymer mixtures of lower average n value may be used, provided that an effective amount of the polymer molecules have one or more n-groups. Dependant on the type and amount of polymer used, the amount of effective polymer as calculated on the basis of the total polymer fraction may be relatively low, for example samples having an average n-value of about 0.1 have been found to be effective as deflocculation polymers.

Gel permeation chromatography (GPC) is widely used to measure the molecular weight distribution of water-soluble polymers. By this method, a calibration is constructed from polymer standards of known molecular weight and a sample of unknown molecular weight distribution is compared with this.

When the sample and standards are of the same chemical composition, the approximate true molecular weight of the sample can be calculated, but if such standards are not available, it is common practice to use some other well characterized standards as a reference. The molecular weight obtained by such means is not the absolute value, but is useful for comparative purposes. Sometimes it will be less than that resulting from a theoretical calculation for a dimer.

It is possible that when the same sample is measured, relative to different sets of standards, different molecular weights can be obtained. We have found this to be the case when using (say) polyethylene glycol, polyacrylate and polystyrene sulphonate standards. For the compositions of the present invention exemplified hereinbelow, the molecular weight is specified by reference to the appropriate GPC standard.

For the polymers of formula (I to VII) and their salts, it is preferred to have a weight average molecular weight in the region of from 500 to 500,000, preferably from 750 to 100,000 most preferably from 1,000 to 30,000, especially from 2,000 to 10,000 when measured by GPC using polyacrylate standards. For the purposes of this definition, the molecular weights of the standards are measured by the absolute intrinsic viscosity method described by Noda, Tsoge and Nagasawa in Journal of Physical Chemistry, Volume 74, (1970), pages 710–719.

As well as the polymers of the above formulas and their salts, many other suitable polymers are known, although previously, not for inclusion in lamellar dispersions of surfactant. Such known polymers are described, for example, in R. Buscall and T. Corner, Colloids and Surfaces, 17 (1986) 25–38; Buscall and Corner, ibid, pp. 39–49; European Patent Applications EP-A-57 875 and EP-A-99 179; U.S. Pat. No. 4,559,159 and UK Patent GB 1 052 924. These references also disclose methods for making the polymers therein described and which, by analogy, those skilled in the art will be capable of adapting for preparing other polymers for use in the present invention. The polymers may also be made by methods generally analogous to any of those described in any of patent documents EP-A-244 066, U.S. Pat. Nos. 3,235,505, 3,328,309 and 3,457,176 referred to hereinbefore.

Most preferably, however, we have found that the polymers for use in the compositions of the present invention can be efficiently prepared using conventional aqueous polymerization procedures, but employing a process wherein the polymerization is carried out in the presence of a suitable cosolvent and wherein the ratio of water to co-solvent is carefully monitored so as to maintain the ratio of water to cosolvent equal or greater than unity during the reaction, thereby keeping the polymer, as it forms, in a sufficiently mobile condition and to prevent unwanted homopolymerization and precipitation of the polymer from the hydrophobic monomer.

A preferred process for preparing the polymers provides a product in unique form as a relatively high solids, low viscosity, opaque or semi-opaque product intermediate between a true clear or limpid solution, and an emulsion consisting entirely of non-agglomerated particles. The product exhibits no gelling, coagulation or product separation on standing for at least two weeks. It is further preferably characterized in that upon dilution in water to 0.25% by weight, the turbidity of the resultant preparation is at least 10 Nephelometric Turbidity Units (N.T.U.'s).

This preferred process is especially suited to preparation of the polymers and salts according to formula (I and II) as hereinbefore defined. The particular cosolvent chosen for the reaction will vary depending upon the particular monomers to be polymerized. The co-solvent selected should be miscible with water, dissolve at least one of the monomers, but not react with the monomers or with the polymer as it is produced and be substantially readily removed by simple distillation or azeotropic distillation procedures.

The particular co-solvent chosen for the reaction will vary depending upon the particular monomers to be polymerised. The cosolvent selected should be miscible with water, dissolve at least one of the monomers, but not react with the monomers or with the polymers as it is produced and be substantially readily removed by simple distillation or azeotropic distillation procedured. Suitable co-solvents include isopropanol, n-propanol, acetone, lower ($C_1$ to $C_4$) alcohols, ketones and esters. Isopropanol and normal propanol are the most preferred.

The ratio of water to co-solvent is preferably carefully regulated. If too low an amount of co-solvent is employed, precipitation of hydrophobic monomer or homopolymer may occur; too high a co-solvent level is more expensive and time-consuming to remove, results in too high product viscosity and, in some cases, may cause precipitation of the water-soluble polymer.

In some case it is critical that the ration of water to cosolvent is equal or greater than unity during the reaction.

The polymerization is carried out in the presence of free-radical initiators. Examples of water-soluble, free-radical initiators which are suitable for the polymerization are the usual thermal decomposition initiators such as hydrogen peroxide, peroxydisulphates, especially sodium peroxydisulphate or ammonium peroxydisulphate, or azo-bis(2-aminopropane) hydrochloride. Redox initiators such as tertiary butyl hydroperoxide/-bisulphite; tertiary butyl hydroperoxide/ sodium formaldehyde sulphoxylate; or hydrogen peroxide with a ferrous compound can also be used.

Preferably, from 0.1 to 5% by weight, based on the sum of the monomers, of the initiators is present in the mixture. The polymerization takes place in an aqueous co-solvent medium, and the concentration is advantageously chosen so that the aqueous co-solvent solution contains from 10 to 55, preferably from 20 to 40% by weight of total monomers. The reaction temperature can vary within wide limits, but is advantageously chosen to be from 60° to 150° C., preferably from 70° to 95° C. If the reaction is carried out at above the boiling point of water, a pressure-tight vessel, such as an autoclave, is chosen as the reaction vessel.

Furthermore, the regulators conventionally used for free-radical polymerization in an aqueous medium, e.g. thioglycolic acid or $C_1$ to $C_4$ aldehydes, or branching agents, such as methylene bisacrylamide or divinyl glycol or TMPTA, can be employed, the amounts being from 0.1 to 10% by weight preferably from 0.5 to 5% by weight, respectively, and the percentages being based on the total amount of the monomers.

The turbidity of the prepared polymers may be measured using a Hach Model 2100A Turbidimeter. It was found that direct measurement on the polymers was not possible, and that useful readings could only be made when the polymers were dilutes to 0.25% by weight solid contents with deionized water.

Generally, the deflocculating polymer will be used at from 0.01% to 5.0% by weight in the composition, most preferably from 0.1% to 2.0%.

Although it is possible to form lamellar dispersions of surfactant in water alone, in many cases it is preferred for the aqueous continuous phase to contain dissolved electrolyte. As used herein, the term electrolyte means any ionic water-soluble material. However, in lamellar dispersions, not all the electrolyte is necessarily dissolved but may be suspended as particles of solid because the total electrolyte concentration of the liquid is higher than the solubility limit of the electrolyte. Mixtures of electrolytes also may be used, with one or more of the electrolytes being in the dissolved aqueous phase and one or more being substantially only in the suspended solid phase. Two or more electrolytes may also be distributed approximately proportionally, between these two phases. In part, this may depend on processing, e.g. the order of addition of components. On the other hand, the term 'salts' includes all organic and inorganic materials which may be included, other than surfactants and water, whether or not they are ionic, and this term encompasses the sub-set of the electrolytes (water-soluble materials).

The only restriction on the total amount of detergent-active material and electrolyte (if any) is that in the compositions of the invention, together they must result in formation of an aqueous lamellar dispersion. Thus, within the ambit of the present invention, a very wide variation in surfactant types and levels is possible. The selection of surfactant types and their proportions, in order to obtain a stable liquid with the required structure will be fully within the capability of those skilled in the art. However, it can be mentioned that an important sub-class of useful compositions is those where the detergent-active material comprises blends of different surfactant types. Typical blends useful for fabric washing compositions include those where the primary surfactant(s) comprise nonionic and/or a non-alkoxylated anionic and/or an alkoxylated anionic surfactant.

In many (but not all) cases, the total detergent-active material may be present at from 2% to 60% by weight of the total composition, for example from 5% to 40% and typically from 10% to 30% by weight. However, one preferred class of compositions comprises at least 20%, most preferably at least 25%, and especially at least 30% of detergent-active material based on the weight of the total composition.

In the case of blends of surfactants, the precise proportions of each component which will result in such stability and viscosity will depend on the type(s) and amount(s) of the electrolytes, as is the case with conventional structured liquids.

In the widest definition the detergent-active material in general, may comprise one or more surfactants, and may be selected from anionic, cationic, nonionic, zwitterionic and amphoteric species, and (provided mutually compatible) mixtures thereof. For example, they may be chosen from any of the classes, sub-classes and specific materials described in 'Surface Active Agents' Vol. I, by Schwartz & Perry, Interscience 1949 and 'Surface Active Agents' Vol. II by Schwartz, Perry & Berch (Interscience 1958), in the current edition of "McCutcheon's Emulsifiers & Detergents" published by the McCutcheon division of Manufacturing Confectioners Company or in 'Tensid-Taschenbuch', H. Stache, 2nd Edn., Carl Hanser Verlag, München & Wien, 1981.

Suitable nonionic surfactants include, in particular, the reaction products of compounds having a hydrophobic group and a reactive hydrogen atom, for example aliphatic alcohols, acids, amides or alkyl phenols with alkylene oxides, especially ethylene oxide, either alone or with propylene oxide. Specific nonionic detergent compounds are alkyl ($C_6$–$C_{18}$) primary or secondary linear or branched alcohols with ethylene oxide, and products made by condensation of ethylene oxide with the reaction products of propylene oxide and ethylenediamine. Other so-called nonionic detergent compounds include long chain tertiary amine oxides, long-chain tertiary phospine oxides and dialkyl sulphoxides.

Suitable anionic surfactants are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced, for example, from tallow or coconut oil, sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty monoglyceride sulphates and sulphonates; sodium and potassium salts of sulphuric acid esters of higher ($C_8$–$C_{18}$) fatty alcohol-alkylene oxide, particularly ethylene oxide, reaction products; the reaction products of fatty acids such as coconut fatty acids esterified with isethionic acid and neutralized with sodium hydroxide; sodium and potassium salts of fatty acid amides of methyl taurine; alkane monosulphonates such as those derived by reacting alpha-olefins ($C_{8-20}$) with sodium bisulphite and those derived from reacting paraffins with $SO_2$ and $Cl_2$ and then hydrolyzing with a base to produce a random sulponate; and olefin sulphonates, which term is used to describe the material made by reacting olefins, particularly $C_{10}$–$C_{20}$ alpha-olefins, with $SO_3$ and then neutralizing and hydrolyzing the reaction product. The preferred anionic detergent compounds are sodium ($C_{11}$–$C_{15}$) alkyl benzene sulphonates and sodium ($C_{16}$–$C_{18}$) alkyl sulphates.

Also possible is that part or all of the detergent active material is an stabilising surfactant, which has an average alkyl chain length greater than 6 C-atoms, and which has a salting out resistance, greater than, or equal to 6.4. These stabilising surfactants are disclosed in our co-pending European patent application 89200163.7. Examples of these materials are alkyl polyalkoxylated phosphates, alkyl polyalkoxylated sulphosuccinates; dialkyl diphenyloxide disulphonates; alkyl polysaccharides and mixtures thereof.

It is also possible, and sometimes preferred, to include an alkali metal soap of a long chain mono- or dicarboxylic acid for example one having from 12 to 18 carbon atoms. Typical acids of this kind are oleic acid, ricinoleic acid, and fatty acids derived from castor oil, rapeseed oil, groundnut oil, coconut oil, palmkernel oil or mixtures thereof. The sodium or potassium soaps of these acids can be used.

Preferably the amount of water in the composition is from 5 to 95%, more preferred from 25 to 75%, most preferred from 30 to 50%. Especially preferred less than 45% by weight.

The compositions optionally also contain electrolyte in an amount sufficient to bring about structuring of the detergent-active material. Preferably though, the compositions contain from 1% to 60%, especially from 10 to 45% of a salting-out electrolyte. Salting-out electrolyte has the meaning ascribed to in specification EP-A-79 646. Optionally, some salting-in electrolyte (as defined in the latter specification) may also be included, provided if of a kind and in an amount compatible with the other components and the composition is still in accordance with the definition of the invention claimed herein. Some or all of the electrolyte (whether salting-in or salting-out), or any substantially water-insoluble salt which may be present, may have detergency builder properties. In any event, it is preferred that compositions according to the present invention include detergency builder material, some or all of which may be electrolyte. The builder material is any capable of reducing the level of free calcium ions in the wash liquor and will preferably provide the composition with other beneficial properties such as the generation of an alkaline pH, the suspension of soil removed from the fabric and the dispersion of the fabric softening clay material.

Examples of phosphorous-containing inorganic detergency builders, when present, include the water-soluble salts, especially alkali metal pyrophosphates, orthophosphates, polyphosphates and phosphonates. Specific examples of inorganic phosphate builders include sodium and potassium tripolyphosphates, phosphates and hexametaphosphates. Phosphonate sequestrant builders may also be used.

Examples of non-phosphorus-containing inorganic detergency builders, when present, include water-soluble alkali metal carbonates, bicarbonates, silicates and crystalline and amorphous aluminosilicates. Specific examples include sodium carbonate (with or without calcite seeds), potassium carbonate, sodium and potassium bicarbonates, silicates and zeolites.

In the context of inorganic builders, we prefer to include electrolytes which promote the solubility of other electrolytes, for example use of potassium salts to promote the solubility of sodium salts. Thereby, the amount of dissolved electrolyte can be increased considerably (crystal dissolution) as described in UK patent specification GB 1 302 543.

Examples of organic detergency builders, when present, include the alkaline metal, ammonium and substituted ammonium polyacetates, carboxylates, polycarboxylates, polyacetyl carboxylates, carboxymethyloxysuccinates, carboxymethyloxymalonates, ethylene diamine-N,N, disuccinic acid salts, polyepoxysuccinates, oxydiacetates, triethylene tetramine hexacetic acid salts, N-alkyl imino diacetates or dipropionates, alpha sulphofatty acid salts, dipicolinic acid slats, oxidised polysaccharides, polyhydroxysulphonates and mixtures thereof.

Specific examples include sodium, potassium, lithium, ammonium and substituted ammonium salts of ethylenediaminetetraacetic acid, nitrilitriacetic acid, oxydisuccinic acid, melitic acid, benzene polycarboxylic acids and citric acid, tartrate mono succinate and tartrate di succinate.

In the context of organic builders, it is also desirable to incorporate polymers which are only partly dissolved in the aqueous continuous phase. This allows a viscosity reduction (owing to the polymer which is dissolved) whilst incorporating a sufficiently high amount to achieve a secondary benefit, especially building, because the part which is not dissolved does not bring about the instability that would occur if substantially all were dissolved.

Examples of partly dissolved polymers include many of the polymer and co-polymers salts already known as detergency builders. For example, may be used (including building and non-building polymers) polyethylene glycols, polyacrylates, polymaleates, polysugars, polysugarsulphonates and co-polymers of any of these. Preferably, the partly dissolved polymer comprises a copolymer which includes an alkali metal salt of a polyacrylic, polymethacrylic or maleic acid or anhydride. Preferably, compositions with these co-polymers have a pH of above 8.0. In general, the amount of viscosity-reducing polymer can vary widely according to the formulation of the rest of the composition. However, typical amounts are from 0.5 to 4.5% by weight.

It is further possible to include in the compositions of the present invention, alternatively, or in addition to the partly dissolved polymer, yet another polymer which is substantially totally soluble in the aqueous phase and has an electrolyte resistance of more than 5 grams sodium nitrilotriacetate in 100 ml of a 5% by weight aqueous solution of the polymer, said second polymer also having a vapour pressure in 20% aqueous solution, equal to or less than the vapour pressure of a reference 2% by weight or greater aqueous solution of polyethylene glycol having an average molecular weight of 6,000; said second polymer having a molecular weight of at least 1,000.

The incorporation of the soluble polymer permits formulation with improved stability at the same viscosity (relative to the composition without the soluble polymer) or lower viscosity with the same stability. The soluble polymer can also reduce viscosity drift, even when it also brings about a viscosity reduction. Here, improved stability and lower viscosity mean over and above any such effects brought about by the deflocculating polymer.

It is especially preferred to incorporate the soluble polymer with a partly dissolved polymer which has a large insoluble component. That is because although the building capacity of the partly dissolved polymer will be good (since relatively high quantities can be stably incorporated), the viscosity reduction will not be optimum (since little will be dissolved). Thus, the soluble polymer can usefully function to reduce the viscosity further, to an ideal level.

The soluble polymer can, for example, be incorporated at from 0.05 to 20% by weight, although usually, from 0.1 to 10% by weight of the total composition is sufficient, and especially from 0.2 to 3.5–4.5% by weight. It has been found that the presence of deflocculating polymer increase the tolerance for higher levels of soluble polymer without stability problems. A large number of different polymers may be used as such a soluble polymer, provided the electrolyte resistance and vapour pressure requirements are met. The former is measured as the amount of sodium nitrilotriacetate (NaNTA) solution necessary to reach the cloud point of 100 ml of a 5% solution of the polymer in water at 25° C., with the system adjusted to neutral pH, i.e. about 7. This is preferably effected using sodium hydroxide. Most preferably, the electrolyte resistance is 10 g NaNTA, especially 15 g. The latter indicates a vapour pressure low enough to have sufficient water binding capability, as generally explained in the Applicants' specification GB-A-2 053 249. Preferably, the measurement is effected with a reference solution at 10% by weight aqueous concentration, especially 18%.

Typical classes of polymers which may be used as the soluble polymer, provided they meet the above requirements, include polyethylene glycols, Dextran, Dextran sulphonates, polyacrylates and polyacrylate/maleic acid co-polymers.

The soluble polymer must have an average molecular weight of at least 1,000 but a minimum average molecular weight of 2,000 is preferred.

The use of partly soluble and the use of soluble polymers as referred to above in detergent compositions is described in our copending European patent applications EP 301 882 and EP 301 883.

Although it is possible to incorporate minor amounts of hydrotropes such as lower alcohols (e.g. ethanol) or alkanolamines (e.g. triethanolamine), in order to ensure integrity of the lamellar dispersion we prefer that the compositions of the present invention are substantially free from hydrotropes. By hydrotrope is meant any water soluble agent which tends to enhance the solubility of surfactants in aqueous solution.

Apart from the ingredients already mentioned, a number of optional ingredients may also be present, for example lather boosters such as alkanolamides, particularly the monoethanolamides derived from palm kernel fatty acids and coconut fatty acids, fabric softeners such as clays, amines and amine oxides, lather depressants, oxygen-releasing bleaching agents such as sodium perborate and sodium percarbonate, peracid bleach precursors, chlorine-releasing bleaching agents such as trichloroisocyanuric acid, inorganic salts such as sodium sulphate, and, usually present in very minor amounts, fluorescent agents, perfumes, enzymes such as proteases, amylases and lipases (including Lipolase (Trade Mark) ex Novo), germicides and colourants.

Amongst these optional ingredients, as mentioned previously, are agents to which lamellar dispersions without deflocculating polymer are highly stability-sensitive and by virtue of the present invention, can be incorporated in higher, more useful amounts. These agents cause a problem in the absence of deflocculating polymer because they tend to promote flocculation of the lamellar droplets. Examples of such agents are soluble polymers, soluble builder such as succinate builders, fluorescers like Blankophor RKH, Tinopal LMS, and Tinopal DMS-X and Blankophor BBH as well as metal chelating agents, especially of the phosphonate type, for example the Dequest range sold by Monsanto.

The invention will now be illustrated by way of the following Examples. In all Examples, unless stated to the contrary, all percentages are by weight.

A. BASE COMPOSITIONS

TABLE 1a

| Composition of basic formulations i.e. without deflocculating polymer. | | | | | |
|---|---|---|---|---|---|
| | Basic formulation (% w/w) | | | | |
| Ingredient | 1 | 2 | 3 | 4 | 5 |
| NaDoBS | 28.0 | 24.5 | 19.7 | 26.7 | 26.1 |
| Synperonic A7 | 6.5 | 9.9 | 7.9 | 10.7 | 10.5 |
| Na Citrate | 16.4 | 16.4 | 11.0 | 9.0 | 10.9 |
| Water | 49.0 | 49.2 | 61.4 | 53.6 | 52.5 |
| Deflocculating polymer | weights additional to basic formulation | | | | |

TABLE 1b

| Composition of basic formulations | | | | | |
|---|---|---|---|---|---|
| | Basic formulation (% w/w) | | | | |
| Ingredient | 6 | 7 | 8 | 9 | 10 |
| NaDoBS | 25.6 | 25.0 | 12.9 | 12.6 | 12.3 |
| Synperonic A7 | 10.3 | 10.0 | 5.2 | 5.1 | 5.0 |
| Na Citrate | 12.8 | 14.7 | 12.9 | 14.8 | 16.5 |
| Water | 51.3 | 50.3 | 69.0 | 67.5 | 66.2 |
| Deflocculating polymer | weights additional to basic formulation | | | | |

TABLE 1c

| Composition of basic formulations. | |
|---|---|
| Ingredient | Basic formulation (% w/w) |
| | 11 |
| NaDoBS | 23.5 |
| Synperonic A7 | 9.5 |
| Na Citrate | 19.7 |
| Water | 47.3 |
| Deflocculating polymer | weights additional to basic formulation |
| | 12 |
| NaDoBS | 17.1 |
| Dobanol 23-6.5 | 7.0 |
| TrEA | 2.0 |
| Na-citrate | 20.0 |
| Deflocculating polymer | if any |
| Water | up to 100 |

TABLE 1d

| Composition of basic formulations | | | | | | | | |
|---|---|---|---|---|---|---|---|---|
| | Basic formulation (% w/w) | | | | | | | |
| Ingredient | 13 | 14 | 15 | 16 | 17 | 18 | 19 | 20 |
| NaDoBS | 8.5 | 8.5 | 8.5 | 8.5 | 7.5 | 7.5 | 6.4 | 4.3 |
| Synperonic A7 | 2.0 | 2.0 | 2.0 | 2.0 | 3.0 | 3.0 | 4.0 | 6.0 |
| Na Oleate | 2.7 | 5.4 | 8.1 | 10.8 | 8.1 | 10.8 | — | — |
| Glycerol | 5.0 | | | | | | | |
| Borax | 3.5 | | | | | | | |
| STP | 22 | | | | | | | |
| Deflocculating Polymer | if any | | | | | | | |
| Water | up to 100 | | | | | | | |

TABLE 1e

| Composition of basic formulations. | | | | | |
|---|---|---|---|---|---|
| | Basic formulation (% w/w) | | | | |
| Ingredient | 21 | 22 | 23 | 24 | 25 |
| NaDoBS | 9.6 | 9.9 | 10.1 | 10.2 | 10.4 |
| Na Oleate | 16.2 | 16.6 | 16.9 | 17.2 | 17.6 |
| Synperonic A7 | 6.0 | 5.3 | 4.8 | 4.4 | 4.0 |
| Glycerol | 5.0 | | | | |
| Borax | 3.5 | | | | |
| STP | 15 | | | | |
| Deflocculating polymer | if any | | | | |
| Water | up to 100 | | | | |

TABLE 1f

| Composition of basic formulations | | | | | |
|---|---|---|---|---|---|
| | Basic formulation (% w/w) | | | | |
| Ingredient | 26 | 27 | 28/31 | 29/32 | 30/33 |
| NaDoBS | 10.2 | 9.6 | 20.6 | 21.5 | 21.8 |
| Na Oleate | 16.9 | 15.9 | — | — | — |
| Synperonic A7 | 4.8 | 4.5 | 4.4 | 3.5 | 3.2 |
| Glycerol | 5.0 | 5.0 | 5.0 | 5.0 | 5.0 |
| Borax | 3.5 | 3.5 | 3.5 | 3.5 | 3.5 |
| STP | 15.0 | 15.0 | 22.0 | 22.0 | 22.0 |
| Silicone oil/DB 100 | 0.25 | 0.25 | 0.25 | 0.25 | 0.25 |

TABLE 1f-continued

| Composition of basic formulations | Basic formulation (% w/w) | | | | |
|---|---|---|---|---|---|
| Ingredient | 26 | 27 | 28/31 | 29/32 | 30/33 |
| Gasil 200 | 2.0 | 2.0 | 2.0 | 2.0 | 2.0 |
| Na SCMC | 0.1 | 0.1 | 0.3 | 0.3 | 0.3 |
| Tinopal CBS-X | 0.1 | 0.1 | 0.1 | 0.1 | 0.1 |
| Blancophor RKH 766 | — | — | 0/0.2 | 0/0.2 | 0/0.2 |
| Dequest 2060S | — | — | 0.4 | 0.4 | 0.4 |
| Perfume | 0.3 | 0.3 | 0.3 | 0.3 | 0.3 |
| Alcalase 2.5L | 0.5 | 0.5 | 0.5 | 0.5 | 0.5 |
| Deflocculating polymer | | | if any | | |
| Water | | | up to 100 | | |

TABLE 1g

| Composition of basic formulations | Basic formulation (% w/w) | |
|---|---|---|
| Ingredient | 34 | 35 |
| NaDoBS | 9.8 | 12.3 |
| Synperonic A7 | 2.3 | 2.9 |
| Glycerol | 5.0 | 6.3 |
| Borax | 3.5 | 4.4 |
| STP | 25.0 | 31.3 |
| Water | 54.4 | 42.8 |
| Deflocculating polymer. | weights additional to basic formulation | |

TABLE 1h

| Composition of basic formulations. | Basic formulation (% w/w) | | | | |
|---|---|---|---|---|---|
| Ingredients | 36 | 37 | 38 | 39 | 40 |
| NaDoBS | ← | ← | 21.5 | → | → |
| Synperonic A7 | ← | ← | 3.5 | → | → |
| Glycerol | ← | ← | 5.0 | → | → |
| Borax | ← | ← | 3.5 | → | → |
| KTP | 0 | 2 | 4 | 6 | 8 |
| STP | 22 | 20 | 18 | 16 | 14 |
| Silicon oil | ← | ← | 0.25 | → | → |
| Gasil 200 | ← | ← | 2.0 | → | → |
| Na SCMC | ← | ← | 0.3 | → | → |
| Tinopal CBS-X | ← | ← | 0.1 | → | → |
| Dequest 2060S (as 100%) | ← | ← | 0.4 | → | → |
| Perfume | ← | ← | 0.3 | → | → |
| Alcalase 2.5L | ← | ← | 0.5 | → | → |
| Deflocculating polymer | ← | ← | 0.75 | → | → |
| Water | ← | ← | 39.9 | → | → |

TABLE 1i

| Composition of basic formulations | Basic formulation (% w/w) | | | | |
|---|---|---|---|---|---|
| Ingredients | 41 | 42 | 43 | 44 | 45 |
| NaDoBS | 9.6 | 9.4 | 9.2 | 8.9 | 8.3 |
| Na-Oleate | 15.9 | 15.6 | 15.3 | 14.7 | 13.7 |
| Synperonic A7 | 4.5 | 4.4 | 4.3 | 4.2 | 3.9 |
| Glycerol | 5.0 | 4.9 | 4.8 | 4.6 | 4.3 |
| Borax | 3.5 | 3.4 | 3.4 | 3.2 | 3.0 |
| KTP | — | 2.0 | 3.8 | 7.4 | 13.8 |
| STP | 15.0 | 14.7 | 14.4 | 13.9 | 12.9 |
| Silicon oil | 0.25 | 0.25 | 0.24 | 0.23 | 0.22 |
| Gasil 200 | 2.0 | 2.0 | 1.9 | 1.9 | 1.7 |
| Na-SCMC | 0.1 | 0.1 | 0.1 | 0.1 | 0.1 |
| Tinopal CBS-X | 0.1 | 0.1 | 0.1 | 0.1 | 0.1 |
| Perfume | 0.3 | 0.3 | 0.3 | 0.27 | 0.26 |
| Alcalase 2.5L | 0.5 | 0.5 | 0.5 | 0.46 | 0.43 |
| Deflocculating polymer | 0.75 | 0.74 | 0.72 | 0.69 | 0.65 |
| Water | 42.5 | 41.6 | 40.9 | 39.4 | 36.6 |

TABLE 1k

| Composition of basic formulations | Basic formulation (% w/w) | | |
|---|---|---|---|
| Ingredient | 46 | 47 | 48 |
| NaDoBS | 27.1 | 31.5 | 33.9 |
| Synperonic A7 | 11.5 | 13.4 | 14.5 |
| NaCitrate | 15.3 | 13.8 | 12.9 |
| Water | 46.1 | 41.3 | 38.7 |
| Deflocculating polymer | Weights additional to basic formulations | | |

TABLE 1l

| Composition of basic formulations | Basic formulation (% w/w) | | | | | | |
|---|---|---|---|---|---|---|---|
| Ingredient | 49 | 50 | 51 | 52 | 53 | 54 | 55 |
| NaLAS | 6.2 | — | — | — | 6.3 | 5.2 | — |
| K LAS | —6.5 | 6.5 | 6.3 | — | — | 6.3 | |
| Na Oleate | 8.8 | — | — | — | — | — | — |
| K Laurate | — | — | 3.8 | — | 3.8 | 3.2 | — |
| K Oleate | — | 9.4 | 5.5 | 9.2 | 5.5 | 4.6 | 9.2 |
| Synperonic A7 | 10.0 | 3.5 | 10.0 | 10.0 | 10.0 | 8.4 | — |
| Synperonic A3 | — | — | — | — | — | — | 10.0 |
| Glycerol | 5.0 | 5.0 | 5.0 | 5.0 | 5.0 | 3.64 | 3.64 |
| Borax | 3.5 | 3.5 | 3.5 | — | — | — | — |
| Boric-acid | — | — | — | 2.28 | 2.28 | 1.66 | 1.66 |
| KOH | — | — | — | 1.0 | 1.0 | 0.75 | 0.75 |
| KTP | 7.0 | — | — | — | — | — | — |
| STP | 15.0 | 20.0 | 19.0 | 20.0 | 19.0 | 20.0 | 20.0 |
| Gasil 200 | 2.0 | 2.0 | 1.5 | 1.5 | 2.0 | — | — |
| Silicon oil | 0.25 | 0.25 | 0.3 | 0.25 | 0.25 | 0.05 | 0.05 |
| Tinopal CBS-X | 0.1 | 0.1 | 0.1 | 0.1 | 0.1 | 0.1 | 0.07 |
| Na-CMC | 0.3 | 0.3 | 0.1 | 0.3 | 0.3 | 0.3 | 0.3 |
| Dequest 2060S (as 100%) | 0.4 | 0.4 | 0.4 | 0.4 | 0.4 | 0.3 | 0.3 |
| Alcalase 2.5 L | 0.5 | 0.5 | 0.5 | 0.5 | 0.5 | 0.5 | 0.5 |
| Perfume | 0.3 | 0.3 | 0.3 | 0.3 | 0.3 | 0.25 | 0.3 |
| Deflocculating Polymer (if any) | 0/ 0.75 | 0/ 0.75 | 0/ 0.75 | 0/ 0.75 | 0/ 0.75 | 0/ 0.75 | 0/ 0.60 |
| Water | | | | up to 100 | | | |

TABLE 1m

| Composition of basic formulations | Basic formulation (% w/w) | | | | |
|---|---|---|---|---|---|
| Ingredient | 56 | 57 | 58 | 59 | 60 |
| NaLAS | 7.9 | 7.9 | 11.5 | 8.1 | 10.0 |
| K Oleate | 1.0 | 1.0 | — | — | — |
| Synperonic A7 | 2.25 | 2.25 | 2.7 | 5.4 | 4.0 |
| Glycerol | 4.8 | 4.8 | 6.7 | 6.7 | 6.7 |
| Borax | 3.1 | 3.1 | 4.7 | 4.7 | 4.7 |
| STP | 23.0 | 23.0 | 8.1 | 8.1 | 8.1 |
| Na-CMC | 0.1 | 0.1 | — | — | — |
| Tinopal CBS-X | 0.1 | 0.1 | — | — | — |
| Silicone | 0.25 | 0.25 | — | — | — |
| Gasil 200 | 2.0 | 2.0 | — | — | — |
| Perfume | 0.3 | 0.3 | — | — | — |
| Dequest 2060S (as 100%) | 0.2 | 0.4 | — | — | — |
| Alcalase 2.5 L | 0.5 | 0.5 | — | — | — |
| Water | | | up to 100 | | |
| Deflocculating polymer | | | weights additional to basic formulation | | |

TABLE 1n

| Composition of basic formulations | Basic formulation (% w/w) | | |
|---|---|---|---|
| Ingredient | 61 | 62 | 63 |
| Na DoBs | 9.1 | 17.3 | 6.4 |
| Synperonic A7 | 3.6 | 1.8 | 3.5 |
| Na Oleate | — | — | — |
| K Oleate | — | — | 8.2 |
| Na Stearate | — | 0.9 | — |
| K Laurate | — | — | 5.7 |
| Glycerol | 8.1 | 3.0 | 5.0 |

TABLE 1n-continued

| Composition of basic formulations | | | |
|---|---|---|---|
| | Basic formulation (% w/w) | | |
| Ingredient | 61 | 62 | 63 |
| Boric-acid | — | — | 2.28 |
| KOH | — | — | 2.2 |
| NaOH | 1.0 | — | — |
| Borax | 5.8 | 2.0 | — |
| Na-citrate | — | 5.0 | — |
| Citric-acid | 1.5 | — | 1.50 |
| Zeolite A4 | 25.3 | 30.0 | 20.0 |
| NaCMC | — | 0.3 | 0.3 |
| Tinopal CBS-X | — | 0.13 | 0.1 |
| Silicon DB100 | — | — | 0.25 |
| Dequest 2060S (as 100%) | — | — | 0.4 |
| Perfume | — | 0.22 | 0.3 |
| Alcalase 2.34 L | — | 0.5 | 0.5 |
| Deflocculating polymer (if any) | 0/0.5 | 0/0.5 | 0/0.5 |
| Water | | up to 100 | |
| pH | 8.8 | 9.1 | 7.7 |

TABLE 1p

| Composition of basic formulations | | | | | | | |
|---|---|---|---|---|---|---|---|
| | Basic formulation (% w/w) | | | | | | |
| Ingredient | 64 | 65 | 66 | 67 | 68 | 69 | 70 |
| Na Dobs | 14.4 | 10.3 | 6.2 | 11.0 | 13.6 | 12.3 | 12.3 |
| Synperonic A7 | 11.6 | 19.3 | 27.0 | 13.8 | 17.0 | 15.4 | 15.4 |
| Na Oleate | 8.7 | 6.2 | 3.7 | 6.7 | 8.2 | 7.5 | 7.5 |
| Na Laurate | 5.9 | 4.3 | 2.6 | 4.6 | 5.7 | 5.1 | 5.1 |
| $Na_2CO_3$ | 4.0 | 4.0 | 4.0 | 4.0 | 4.0 | 2.0 | 6.0 |
| Glycerol | | | | 5.0 | | | |
| Borax | | | | 3.5 | | | |
| Dequest 2066 (as 100%) | | | | 0.4 | | | |
| Silicon DB100 | | | | 0.1 | | | |
| Savinase | | | | 0.3 | | | |
| Amylase | | | | 0.1 | | | |
| Tinopal CBS-X | | | | 0.1 | | | |
| Perfume | | | | 0.3 | | | |
| Deflocculating polymer (if any) | | | | 0/1.0 | | | |
| Water | | | | up to 100 | | | |
| pH | | | | 9.7–10.0 | | | |

TABLE 1q

| Composition of basic formulations | | | | | | | |
|---|---|---|---|---|---|---|---|
| | Basic formulation (% w/w) | | | | | | |
| Ingredient | 71 | 72 | 73 | 74 | 75 | 76 | 77 |
| Na Dobs | 14.4 | 10.3 | 11.0 | 12.3 | 13.6 | 12.3 | 12.3 |
| Synperonic A7 | 11.6 | 19.3 | 13.8 | 15.4 | 17.0 | 15.4 | 15.4 |
| Na Oleate | 8.7 | 6.2 | 6.7 | 7.5 | 8.2 | 7.5 | 7.5 |
| Na Laurate | 5.9 | 4.3 | 4.6 | 5.1 | 5.7 | 5.1 | 5.1 |
| $K_2SO_4$ | 6.0 | 6.0 | 6.0 | 6.0 | 6.0 | 1.0 | 3.0 |
| Glycerol | | | | 5.0 | | | |
| Borax | | | | 3.5 | | | |
| Dequest 2066 (as 100%) | | | | 0.4 | | | |
| Silicon DB100 | | | | 0.1 | | | |
| Savinase | | | | 0.3 | | | |
| Amylase | | | | 0.1 | | | |
| Tinopal CBS-X | | | | 0.1 | | | |
| Perfume | | | | 0.3 | | | |
| Deflocculating polymer (if any) | | | | 0/1.0 | | | |
| Water | | | | up to 100 | | | |
| pH | | | | 8.3–8.8 | | | |

TABLE 1r

| Composition of basic formulations | | | | | | | |
|---|---|---|---|---|---|---|---|
| | Basic formulation (% w/w) | | | | | | |
| Ingredient | 78 | 79 | 80 | 81 | 82 | 83 | 84 |
| Na Dobs | 14.4 | 10.3 | 6.2 | 9.2 | 11.3 | 10.3 | 10.3 |
| Synperonic A7 | 11.6 | 19.3 | 27.0 | 17.3 | 21.3 | 19.3 | 19.3 |
| Na Oleate | 8.7 | 6.2 | 3.7 | 5.6 | 6.9 | 6.2 | 6.2 |
| Na Laurate | 5.9 | 4.3 | 2.6 | 3.8 | 4.7 | 4.3 | 4.3 |
| Na-citrate.2aq | 10.0 | 10.0 | 10.0 | 10.0 | 10.0 | 6.0 | 12.0 |
| Glycerrol | | | | 5.0 | | | |
| Dequest 2066 (as 100%) | | | | 0.4 | | | |
| Silicon DB100 | | | | 0.1 | | | |
| Savinase | | | | 0.3 | | | |
| Amylase | | | | 0.1 | | | |
| Tinopal CBS-X | | | | 0.1 | | | |
| Perfume | | | | 0.3 | | | |
| Deflocculating polymer (if any) | | | | 0/1.0 | | | |
| Water | | | | up to 100 | | | |
| pH | | | | 7.0–9.8 | | | |

TABLE 1s

| Composition of basic formulation | | | | | | | |
|---|---|---|---|---|---|---|---|
| | Basic formulation (% w/w) | | | | | | |
| Ingredient | 85 | 86 | 87 | 88 | 89 | 90 | 91 |
| Na Dobs | 14.4 | 10.3 | 11.3 | 9.2 | 11.3 | 10.3 | 10.3 |
| Synperonic A7 | 11.6 | 19.3 | 17.4 | 17.3 | 21.3 | 19.3 | 19.3 |
| Na Oleate | 8.7 | 6.2 | 6.9 | 5.6 | 6.9 | 6.2 | 6.2 |
| Na Laurate | 5.9 | 4.3 | 4.7 | 3.8 | 4.7 | 4.3 | 4.3 |
| N-CMOS (75%) | 10.0 | 10.0 | 10.0 | 10.0 | 10.0 | 8.0 | 12.0 |
| Glycerol | | | | 5.0 | | | |
| Borax | | | | 3.5 | | | |
| Silicon DB100 (as 100%) | | | | 0.1 | | | |
| Savinase | | | | 0.3 | | | |
| Amylase | | | | 0.1 | | | |
| Tinopal CBS-X | | | | 0.1 | | | |
| Perfume | | | | 0.3 | | | |
| Deflocculating polymer (if any) | | | | 0/1.0 | | | |
| Water | | | | up to 100 | | | |
| pH | | | | 8.2–9.0 | | | |

TABLE 1t

| Composition of basic formulations | | |
|---|---|---|
| | Basic formulation (% w/w) | |
| Ingredient | 92 | 93 |
| Na Dobs | 10.2 | — |
| K Dobs | — | 10.7 |
| Synperonic A7 | 19.3 | 19.3 |
| Na Oleate | 10.3 | — |
| K Oleate | — | 10.9 |
| Glycerol | 5.0 | 5.0 |
| Borax | 3.5 | 3.5 |
| Na-citrate 2aq | 10.0 | — |
| $Na_2CO_3$ | — | 4.0 |
| Sokalan CP5 | 2.5 | — |
| Dequest 2066 (as 100%) | 0.4 | 0.4 |
| Silicon DB100 | 0.3 | 0.3 |
| Tinopal CBS-X | 0.5 | 0.5 |
| Savinase | 0.3 | 0.3 |
| Amylase | 0.1 | 0.1 |
| Perfume | 0.1 | 0.1 |
| Dye | 0.3 | 0.3 |
| Deflocculating polymer (in any) | 0/1.0 | 0/1.0 |
| water | up to 100 | |

B. PREPARATION OF POLYMERS

The following is the method used to prepare the polymer hereinafter designated by the reference A-15.

All other polymers of Table 2a-2g can be prepared in principle in an analogous manner.

A monomer mixture was prepared consisting of a hydrophilic monomer (acrylic acid 216 g, 3.0 moles) and a hydrophobic monomer (Methacrylester 13 (Trade Mark), average chain length 13 carbon atoms, available from Rohm, 32 g, 0.12 moles). This gave a molar ratio of hydrophilic to hydrophobic monomer of 25:1.

To a 2 liter glass round bottomed reaction vessel, equipped with a condenser, stainless steel paddle stirrer, and thermometer, was added 600 g of an aqueous mixture of isopropanol and water, consisting of 400 g deionized water and 200 g isopropanol. This gave a molar ratio of water, cosolvent mixture to total weight of monomers of 2.42:1 and a water to isopropanol ratio of 2:1.

The monomer mixture was pumped into the reaction vessel over a period of about 3 hours, keeping the reaction mass at 80°-85° C., with simultaneous introduction over a period of 4 hours, by pumping in an independent stream, of an initiator solution consisting of 100 g of a 4% aqueous solution of sodium persulphate.

After addition of the initiator, the ratio of water and cosolvent to polymer had risen to 2.81:1 and the water to isopropanol ratio to 2.5:1. The reaction contents were held at 80°-85° C. for a period of about one further hour, giving a total time from the start of the monomer and initiator additions of about 5 hours.

The isopropanol was then substantially removed from the reaction product by azeotropic distillation under vacuum, until the residual isopropanol content was less than 1% as measured by direct gas solid chromatography using a flame ionization detector.

The polymer was neutralized to approximately pH 7 by adding, at 40° C. and below, 230 grams (2.76 moles) of 48% caustic soda solution with water added back as necessary to bring the solids to approximately 35%.

The product was an opaque viscous product, having a solids content of approximately 35% and a viscosity of 1500 cps at 23° C. as measured by a Brookfield Synchro-Lectric viscometer model RVT, spindle 4, at 20 rpm.

The molecular weight distribution of the polymer produced was measured by aqueous gel permeation chromatography, using an ultra violet detector set at 215 nm. The number average (Mn) and weight average (Mw) molecular weights were measured from the chromatogram so produced, using fractionated sodium polyacrylate standards to construct a calibration graph. The molecular weight of 25 these standards had been measured by the absolute intrinsic viscosity method described in the aforementioned reference of Noda, Tsuge and Nagasawa.

The polymer produced had a Mn of 1600 and Mw of 4300. The pH of the product was 7.0 and an 0.25% by weight solution on solids had a turbidity of 110 N.T.U.'s.

In the following Tables 2a, 2b, 2c, the structures of various deflocculating polymers are given using the notation of the general formula (I). Co-polymers are designated by the prefix A- (Tables 2a, 2b) whilst multi-polymers are designated by the prefix B- (Table 2c).

In Table 2b, although the polymers are stated to be sodium salts ($A^1$, $A^4$=Na), some samples are only partially neutralised (some of $A^1$, $A^4$=H). The degree of neutralisation is indicated by way of the approximate pH of the sample.

Instead of quoting a value for n according to formula (I-VII), we prefer to specify the weight average molecular weight (MW) as measured by GPC with polyacrylate standards as hereinbefore described. It is believed that this will be more meaningful to those skilled in the art.

In each Table, some moieties are common to each sample thus:

Table 2a: y is zero, $R^1$ is —CO—O— and $A^1$ is Na.

Table 2b: y is zero, $R^1$ is —CO—O—, $R^2$ and $R^3$ are absent and $A^1$ is Na.

Table 2c: y is zero, $R^3$ is absent, $R^5$ is —H and $A^1$ is Na.

Table 2d: $R^1$ is —CO—O—, $R^2$ and $R^3$ are absent, $R^4$ is $—C_{12}H_{25}$, $R^6$ is methyl and $A^1$, $A^2$ and $A^3$ are all Na.

TABLE 2a

Basic Structures of Deflocculating Polymers: general formula I

| Polymer Type | x | $R^2$ | $R^3$ | $R^4$ | $R^5$ | $R^6$ | MW (cf n) |
|---|---|---|---|---|---|---|---|
| A-1 | 62 | $—(C_2H_4O)_5—$ | —Ph— | $—C_9H_{11}$ | —H | —H | 2.3K |
| A-2 | 82 | $—(C_2H_4O)_{10}—$ | —Ph— | " | —H | —H | 2.1K |
| A-3 | 6 | $—(C_2H_4O)_3—$ | — | $—C_{12}H_{25}$ | —H | $—CH_3$ | 1.7K |
| A-4 | 33 | $—(C_2H_4O)_{11}—$ | — | $—C_{17}H_{25}$ | —H | $—CH_3$ | 1.5K |
| A-5 | 8 | $—(CH(C_2H_5)CH_2O)_3—$ | — | —H | —H | $—CH_3$ | 1.5K |
| A-6 | 25 | " | — | —H | —H | $—CH_3$ | 2.6K |
| A-7 | 100 | $—(C_2H_4O)_7—$ | — | $—C_{12}H_{25}$ | —H | $—CH_3$ | 3.5K |
| A-8 | 50 | " | — | " | —H | $—CH_3$ | 2.5K |
| A-9 | 25 | " | — | " | —H | $—CH_3$ | 1.8K |
| A-10 | 12 | " | — | " | —H | $—CH_3$ | 1.2K |
| A-11 | 25 | — | — | " | —H | $—CH_3$ | 3.5K |
| A-12 | 25 | $—(CH(CH_3)CH_2O)_6—$ | — | —H | —H | $—CH_3$ | 2.2K |
| A-13 | 25 | — | — | $—CH(C_2H_5)C_5H_{11}—$ | —H | —H | 2.1K |
| A-14 | 17 | $—(C_2H_4O)_3—$ | — | $—C_{12}H_{25}$ | $—CO_2Na$ | $—CH_3$ | 3.1K |
| A-15 | 25 | — | — | " | —H | $—CH_3$ | 4.5K |
| A-16 | 25 | $—(CH(C_2H_5)(CH_2O)_6—$ | — | —H | 'H | $—CH_3$ | 2.6K |

TABLE 2b

Basic Structures of Deflocculating Polymers: general formula I

| Polymer Type | x | Approx. pH | $R^4$ | $R^5$ | $R^6$ | MW (cf n) |
|---|---|---|---|---|---|---|
| A-17 | 50 | 7 | $—C_{12}H_{25}$ | —H | $—CH_3$ | 3.6K |
| A-18 | 100 | 7 | " | —H | $—CH_3$ | 3.0K |
| A-19 | 25 | 5 | " | —H | $—CH_3$ | 15.2K |
| A-20 | 50 | 5 | " | —H | $—CH_3$ | 15.0K |

TABLE 2b-continued

| Basic Structures of Deflocculating Polymers: general formula I | | | | | | |
|---|---|---|---|---|---|---|
| Polymer Type | x | Approx. pH | $R^4$ | $R^5$ | $R^6$ | MW (cf n) |
| A-21 | 100 | 5 | " | —H | $—CH_3$ | 14.2K |
| A-22 | 25 | 4.9 | " | —H | $—CH_3$ | 8.7K |
| A-23 | 25 | 3.8 | " | —H | $—CH_3$ | 32.0K |
| A-24 | 25 | 7 | $—C_{10}H_{21}$ | —H | $—CH_3$ | 5.0K |
| A-25 | 25 | 7 | $—C_{16/18}H_{33/37}$ | —H | $—CH_3$ | 4.2K |
| A-26 | 25 | 4.3 | $—C_{10}H_{21}$ | —H | $—CH_3$ | 21.0K |
| A-27 | 25 | 4.3 | $—C_{16/18}H_{33/37}$ | —H | $—CH_3$ | 20.4K |
| A-28 | 25 | 7 | $—C_8H_{17}$ | $—CO_2Na$ | —H | 5.9K |
| A-29 | 8.8 | 7 | " | " | —H | 4.1K |
| A-30 | 25 | 7 | $—C_{12}H_{25}$ | " | —H | 3.0K |
| A-31 | 8.8 | 7 | " | " | —H | 3.1K |
| A-32 | 25 | 7 | $—C_{18}H_{37}$ | " | —H | 5.2K |
| A-33 | 8.8 | 7 | " | " | —H | 6.2K |
| A-34 | 500 | | $—C_{12}H_{25}$ | —H | $—CH_3$ | 4.5K |
| A-35 | 250 | | " | " | " | 5.5K |
| A-36 | 12 | | " | " | " | 4.1K |
| A-37 | 6 | | " | " | " | 3.2K |
| A-38 | 500 | | " | " | " | 27K |
| A-39 | 250 | | " | " | " | 21K |
| A-40 | 12 | | " | " | " | 20K |
| A-41 | 6 | | " | " | " | 27K |
| A-42 | 500 | | " | " | " | 53K |
| A-43 | 250 | | " | " | " | 58K |
| A-44 | 50 | | " | " | " | 7.5K |
| A-45 | 25 | | " | " | " | 7.2K |

TABLE 2c

| Basic Structures of Deflocculating Polymers: general formula I | | | | | | | |
|---|---|---|---|---|---|---|---|
| Polymer Type | x | Approx. pH | $R^1$ | $R^2$ | $R^4$ | $R^6$ | Mw (cf n) |
| A-46 | 25 | 6.8 | —O—CO— | — | $—C_{12}H_{25}$ | — | 4.4K |
| A-47 | 25 | 7.2 | —O—CO— | — | $—(C(CH_3)(C_2H5)(C_5H_{11}))$ | — | 4.6K |
| A-48 | 25 | 7.2 | —O— | $—(C_2H_5O)_4(CH(CH_3)CH_2O)_{12}$ | —H | — | 4.5K |
| A-49 | 25 | 4.5 | —O— | $—(C_2H_5O)_4(CH(CH_3)CH_2O)_{24}$ | —H | — | 3.1K |

TABLE 2d

| Basic Structures of Deflocculating Polymers: general formula I | | | | |
|---|---|---|---|---|
| Polymer Type | x | y | $R^5$ | MW (cf n) |
| B-1 | 46 | 13 | —H | 35.0K |
| B-2 | 46 | 13 | —H | 16.5K |
| B-3 | 46 | 13 | —H | 8.3K |
| B-4 | 32 | 21 | —H | 9.8K |
| B-5 | 21 | 5.9 | —H | 15.5K |
| B-6 | 21 | 5.9 | —H | 5.3K |
| B-7 | 8 | 5.3 | —H | 6.2K |
| B-8 | 8 | 5.3 | —H | 3.1K |
| B-9 | 16.8 | 11.2 | $—COOA^1$ | 2.8K |

Table 2e: $R^1$ is —CO—O—, $R^2$ and $R^3$ are absent, $R^4$ is $—C_{12}H_{25}$, $R^5$ is —H, $R^6$ is $—CH_3$, q is zero and $A^1$–$A^3$ are Na.

Table 2f: y is zero, $R^2$ and $R^3$ are absent, $R^4$ is $—C_{12}H_{25}$, $R^5$ is —H, $R^6$ is $—CH_3$, $R^7$ and $R^8$ are —H, $A^1$ is Na.

Table 2g: y is zero, $R^1$ is —CO—O—, $R^2$ and $R^3$ are absent, $R^4$ is $—C_{12}H_{25}$, $R^5$ is —H, $R^6$ is $—CH_3$ and $A^1$–$A^3$ are Na.

Table 2h: $R^2$ and $R^3$ are absent, $A^1$ is Na.

Table 2k: $R^2$ and $R^3$ are absent; $R^5$ and $R^6$ are —H; $A^1$ is —H or a branching point; and in the molecular entities of formula (III) in the side-chain $R^{1,5-6}$ are as above and $R^4$ is —H.

TABLE 2e

| Basic Structures of Deflocculating Polymers: general formula II | | | | | | | | | |
|---|---|---|---|---|---|---|---|---|---|
| Polymer Type | x | y | p | q | $R^7$ | $R^8$ | $R^9$ | $R^{10}$ | MW (cf n) |
| B-10 | 25 | 0 | 1 | 0 | $—CH_3$ | — | $—CO—O—(C_2H_4O)_{17}—H$ | — | 6.0K |
| B-11 | 0 | 0 | 25 | 0 | —H | — | $—CO—O—C_2H_4OH$ | — | 5.2K |
| B-12 | 13.9 | 9.2 | 1 | 0 | —H | — | $—SO_3Na$ | — | 3.1K |
| B-13 | 22.5 | 0 | 2.5 | 0 | —H | — | $—SO_3Na$ | — | 3.7K |
| B-14 | 22.5 | 0 | 2.5 | 0 | $—CH_3$ | — | $—CO—O—C_2H_4—OSO_3Na$ | — | 4.1K |
| B-15 | 22.5 | 0 | 2.5 | 0 | —H | — | $—CO—NH—C(C_2H_6)—SO_3Na$ | — | 4.8K |

TABLE 2f

| Basic Structures of Deflocculating Polymer: general formula II | | | | | | | | |
|---|---|---|---|---|---|---|---|---|
| Polymer Type | x | p | q | $R^1$ | $R^9$ | $R^{10}$ | MW (cf n) estimated | Reference |
| B-16 | 0 | 25-500 | 0 | —CO—O— | $—CO—NH_2$ | — | 40K | U.S. 4,528,348 |

TABLE 2f-continued

| Polymer Type | x | p | q | $R^1$ | $R^9$ | $R^{10}$ | MW (cf n) estimated | Reference |
|---|---|---|---|---|---|---|---|---|
| | | Basic Structures of Deflocculating Polymer: general formula II | | | | | | |
| B-17 | 0 | 25-500 | 0 | —CO—NH— | —CO—$NH_2$ | — | 40K | U.S. 4,520,182 |
| B-18 | 0 | 25-500 | 0 | —CO—O— | —CO—$NH_2$ | — | 40K | U.S. 4,521,580 |
| B-19 | 25-500 | 25-500 | 0 | —CO—NH— | —CO—$NH_2$ | — | 40K | |
| B-20 | 25-500 | 25-500 | 0 | —CO—O— | —OH | — | 3-60K | |
| B-21 | 25-500 | 25-500 | 25-500 | —CO—O— | —OH | —O—CO—$CH_3$ | 3-60K | |

TABLE 2g

Basic Structures of Deflocculating Polymers: general formula II with introduction of some branching by TMPTA

| Polymer Type | x | r | $Q^1$ | MW (cf n) |
|---|---|---|---|---|
| B-22 | 25 | 0.25 | TMPTA | 3.4K |
| B-23 | 25 | 0.50 | TMPTA | 3.2K |
| B-24 | 25 | 0.75 | TMPTA | 3.1K |

TABLE 2h

Basic Structures of Deflocculating Polymers: general formula IV

| Polymer Type | x + y | $R^1$ | $R^4$ estimated | $R^{11}$ | $R^{12}$ | Mw (cf n) | Reference |
|---|---|---|---|---|---|---|---|
| B-25 | 6-20 | —NH—CO— or $CH_2$—O—CO— | —$C_2{}^1H_{25}$ | —NH—CO—$CH_3$, —$COOA^1$ or —OH | —$CH_2OH$ or —$COOA^1$ | 30K | Biosan LP31 (ex Petroferm) |

TABLE 2k

Basic Structures of Deflocculating Polymers: general formula III

| Polymer type | x | z | $R^1$ | $R^4$ | MW (cf n) |
|---|---|---|---|---|---|
| A-50 | 25 | 1 | —O— | —$C_{12}H_{25}$ | 2.1 k |

EXAMPLES 1-301

Effect of Deflocculating Polymers on Physical Properties of Liquid Detergent Formulations.

| Example | Basic Composition | Polymer Type | % | Product Stability | Viscosity m Pas at $21s^{-1}$ |
|---|---|---|---|---|---|
| 1 | 1 | — | — | Unstable | 1430-1740 |
| 2 | 1 | A-1 | 0.5 | Stable | 260 |
| 3 | 1 | A-1 | 1.0 | Stable | 100 |
| 4 | 1 | A-1 | 2.0 | Stable | 140 |
| 5 | 1 | A-2 | 0.5 | Stable | 260 |
| 6 | 1 | A-2 | 1.0 | Stable | 70 |
| 7 | 1 | A-2 | 2.0 | Stable | 100 |
| 8 | 1 | A-3 | 0.5 | Stable | 280 |
| 9 | 1 | A-3 | 1.0 | Stable | 440 |
| 10 | 2 | — | — | Unstable | 2560 |
| 11 | 2 | A-1 | 0.5 | Stable | 35 |
| 12 | 2 | A-1 | 1.0 | Stable | 35 |
| 13 | 2 | A-1 | 2.0 | Stable | 35 |
| 14 | 2 | A-2 | 0.5 | Stable | 35 |
| 15 | 2 | A-2 | 1.0 | Stable | 35 |
| 16 | 2 | A-2 | 2.0 | Stable | 35 |
| 17 | 2 | A-4 | 0.5 | Stable | 80 |
| 18 | 2 | A-4 | 1.0 | Stable | 110 |
| 19 | 2 | A-4 | 2.0 | Stable | 210 |
| 20 | 1 | — | — | Unstable | 1430-1740 |
| 21 | 1 | A-14 | 0.25 | Stable | 130 |
| 22 | 1 | A-14 | 0.50 | Stable | 70 |
| 23 | 1 | A-14 | 1.0 | Stable | 35 |
| 24 | 1 | A-14 | 2.0 | Stable | 60 |
| 25 | 1 | A-5 | 0.5 | Stable | 480 |
| 26 | 1 | A-4 | 0.5 | Stable | 340 |
| 27 | 1 | A-4 | 1.0 | Stable | 440 |
| 28 | 1 | A-4 | 2.0 | Stable | 130 |
| 29 | 3 | — | — | Unstable | 500 |

-continued

| Example | Basic Composition | Polymer Type | % | Product Stability | Viscosity m Pas at $21s^{-1}$ |
|---|---|---|---|---|---|
| 30 | 3 | A-1 | 0.5 | Stable | 290 |
| 31 | 3 | A-1 | 1.0 | Stable | 1220 |
| 32 | 3 | A-1 | 2.0 | Stable | 1520 |
| 33 | 3 | A-2 | 0.5 | Stable | 530 |
| 34 | 4 | — | — | Unstable | 1600 |
| 35 | 4 | A-1 | 0.5 | Stable | 630 |
| 36 | 4 | A-2 | 0.5 | Stable | 500 |
| 37 | 8 | — | — | Unstable | 190 |
| 39 | 8 | A-2 | 1 | Stable | 1570 |
| 40 | 9 | — | — | Unstable | 90 |
| 41 | 9 | A-2 | 1 | Stable | 610 |
| 42 | 10 | — | — | Unstable | 40 |
| 43 | 10 | A-2 | 1 | Stable | 240 |
| 44 | 5 | — | — | Unstable | 1380 |
| 45 | 5 | A-2 | 1 | Stable | 200 |
| 46 | 6 | — | — | Unstable | 2400 |
| 47 | 6 | A-2 | 1 | Stable | 70 |
| 48 | 7 | — | — | Unstable | 2300 |
| 49 | 7 | A-2 | 1 | Stable | 40 |
| 50 | 2 | — | — | Unstable | 2560 |
| 51 | 2 | A-2 | 1 | Stable | 60 |
| 52 | 6 | — | — | Unstable | 1600-2070 |
| 53 | 6 | A-7 | 0.50 | Stable | 80 |
| 54 | 6 | A-7 | 1.0 | Stable | 100 |
| 55 | 6 | A-7 | 2.0 | Stable | 120 |
| 56 | 6 | A-8 | 0.25 | Stable | 160 |
| 57 | 6 | A-8 | 0.50 | Stable | 190 |
| 58 | 6 | A-8 | 1.0 | Stable | 460 |
| 59 | 6 | A-11 | 0.5 | Stable | 700 |
| 60 | 6 | A-11 | 1.0 | Stable | 760 |
| 61 | 2 | — | — | Unstable | 1160-2560* |
| 62 | 2 | A-7 | 0.5 | Stable | 130 |
| 63 | 2 | A-7 | 1.0 | Stable | 80 |
| 64 | 2 | A-7 | 2.0 | Stable | 120 |
| 65 | 2 | A-8 | 1.0 | Stable | 100 |
| 66 | 2 | A-8 | 2.0 | Stable | 120 |
| 67 | 2 | A-9 | 0.5 | Stable | 150 |
| 68 | 2 | A-9 | 1.0 | Stable | 110 |
| 69 | 2 | A-9 | 2.0 | Stable | 200 |
| 70 | 2 | — | — | Unstable | 1160-2560* |
| 71 | 2 | A-10 | 0.5 | Stable | 410 |
| 72 | 2 | A-10 | 1.0 | Stable | 330 |
| 73 | 2 | A-11 | 1.0 | Stable | 140 |
| 74 | 2 | A-11 | 2.0 | Stable | 210 |
| 75 | 6 | — | — | Unstable | 1600-2070* |
| 76 | 6 | A-12 | 2.0 | Stable | 70 |
| 77 | 6 | A-6 | 1.0 | Stable | 50 |
| 78 | 6 | A-6 | 2.0 | Stable | 70 |
| 79 | 6 | A-13 | 2.0 | Stable | 70 |
| 80 | 2 | — | — | Unstable | 1160-2560* |
| 81 | 2 | A-12 | 2.0 | Stable | 80 |
| 82 | 2 | A-6 | 1.0 | Stable | 100 |
| 83 | 2 | A-6 | 2.0 | Stable | 100 |
| 84 | 2 | A-13 | 2.0 | Stable | 90 |
| 85 | 11 | — | — | Unstable | ** |

-continued

| Example | Basic Composition | Polymer Type | % | Product Stability | Viscosity m Pas at $21s^{-1}$ |
|---|---|---|---|---|---|
| 86 | 11 | A-12 | 1.0 | Stable | 120 |
| 87 | 11 | A-12 | 2.0 | Stable | 120 |
| 88 | 11 | A-13 | 2.0 | Stable | 120 |
| 89 | 12 | — | — | Unstable | ** |
| 90 | 12 | A-1 | 0.1 | Stable | 20 |
| 91 | 12 | A-1 | 2.0 | Stable | 70 |
| 92 | 13 | — | — | Unstable | 660 |
| 93 | 13 | A-2 | 0.5 | Stable | 540 |
| 94 | 13 | A-2 | 1.0 | Stable | 600 |
| 95 | 14 | — | — | Unstable | 700 |
| 96 | 14 | A-2 | 1.0 | Stable | 160 |
| 97 | 14 | A-2 | 2.0 | Stable | 700 |
| 98 | 15 | — | — | Unstable | 2240 |
| 99 | 15 | A-2 | 2.0 | Stable | 300 |
| 100 | 16 | — | — | Unstable | >9000 |
| 101 | 16 | A-2 | 2.0 | Stable | 150 |
| 102 | 17 | — | — | Unstable | 730 |
| 103 | 17 | A-2 | 0.5 | Stable | 300 |
| 104 | 17 | A-2 | 1.0 | Stable | 990 |
| 105 | 18 | — | — | Unstable | 2490 |
| 106 | 18 | A-2 | 0.5 | Stable | 100 |
| 107 | 18 | A-2 | 1.0 | Stable | 510 |
| 108 | 18 | A-2 | 2.0 | Stable | 380 |
| 109 | 19 | — | — | Unstable | 950 |
| 110 | 19 | A-2 | 0. | Stable | 670 |
| 111 | 20 | — | — | Unstable | 950 |
| 112 | 20 | A-2 | 2.0 | Stable | 1430 |
| 113 | 21 | — | — | Unstable | 2730 |
| 114 | 21 | A-1 | 0.5 | Stable | 750 |
| 115 | 22 | — | — | Unstable | 5550 |
| 116 | 22 | A-1 | 0.5 | Stable | 430 |
| 117 | 23 | — | — | Unstable | 6630 |
| 118 | 23 | A-1 | 0.5 | Stable | 220 |
| 119 | 24 | — | — | Unstable | 7950 |
| 120 | 24 | A-1 | 0.5 | Stable | 270 |
| 121 | 25 | — | — | Unstable | 8620 |
| 122 | 25 | A-1 | 0.5 | Stable | 270 |
| 123 | 26 | — | — | Unstable | 5970 |
| 124 | 26 | A-1 | 0.5 | Stable | 800 |
| 125 | 26 | — | — | Unstable | 5970 |
| 126 | 26 | A-6 | 1.0 | Stable | 700 |
| 127 | 26 | A-7 | 0.5 | Stable | 1080 |
| 128 | 26 | A-8 | 0.5 | Stable | 1510 |
| 129 | 26 | A-11 | 0.5 | Stable | 1060 |
| 130 | 27 | — | — | Unstable | 5050 |
| 131 | 27 | A-1 | 0.25 | Stable | 760 |
| 132 | 27 | A-1 | 0.50 | Stable | 660 |
| 133 | 27 | A-1 | 0.75 | Stable | 850 |
| 134 | 27 | A-1 | 1.0 | Stable | 1180 |
| 135 | 27 | A-11 | 0.50 | Stable | 660 |
| 136 | 27 | A-11 | 0.75 | Stable | 750 |
| 137 | 27 | A-11 | 1.0 | Stable | 850 |
| 138 | 29 | — | — | Stable | >9000 |
| 139 | 29 | A-11 | 0.5 | Stable | 1060 |
| 140 | 30 | — | — | Stable | >9000 |
| 141 | 30 | A-11 | 0.5 | Stable | 900 |
| 142 | 31 | — | — | Stable | >9000 |
| 143 | 31 | A-11 | 0.5 | Stable | 1820 |
| 144 | 32 | — | — | Stable | >9000 |
| 145 | 32 | A-11 | 0.5 | Stable | 1240 |
| 146 | 33 | — | — | Stable | >9000 |
| 147 | 33 | A-11 | 0.5 | Stable | 810 |
| 148 | 34 | — | — | Unstable | 170 |
| 149 | 34 | A-2 | 1 | Stable | 1400 |
| 150 | 35 | — | — | Unstable | 6000 |
| 151 | 35 | A-2 | 0.5 | Stable | 350 |
| 152 | 35 | A-2 | 1 | Stable | 600 |
| 153 | 35 | A-2 | 2 | Stable | 2000 |
| 154 | 36 | A-11 | 0.75 | Stable | 1820 |
| 155 | 37 | A-11 | 0.75 | Stable | 1110 |
| 156 | 38 | A-11 | 0.75 | Stable | 750 |
| 157 | 39 | A-11 | 0.75 | Stable | 590 |
| 158 | 40 | A-11 | 0.75 | Stable | 500 |
| 159 | 41 | A-11 | 0.75 | Stable | 860 |
| 160 | 42 | A-11 | 0.74 | Stable | 670 |
| 161 | 43 | A-11 | 0.72 | Stable | 530 |
| 162 | 44 | A-11 | 0.69 | Stable | 400 |
| 163 | 45 | A-11 | 0.65 | Stable | 490*** |
| 164 | 6 | A-16 | 1 | Stable | 50 |

-continued

| Example | Basic Composition | Polymer Type | % | Product Stability | Viscosity m Pas at $21s^{-1}$ |
|---|---|---|---|---|---|
| 165 | 6 | A-16 | 2 | Stable | 70 |
| 166 | 2 | A-16 | 1 | Stable | 100 |
| 167 | 2 | A-16 | 2 | Stable | 100 |
| 168 | 2 | A-46 | 1 | Stable | 60 |
| 169 | 2 | A-47 | 1 | Stable | 50 |
| 170 | 2 | A-47 | 2 | Stable | 50 |
| 171 | 2 | A-48 | 2 | Stable | 1160 |
| 172 | 2 | A-49 | 2 | Stable | 2440 |
| 173 | 2 | A-34 | 2 | Stable | 60 |
| 174 | 2 | A-35 | 2 | Stable | 70 |
| 175 | 2 | A-18 | 0.5 | Stable | 75 |
| 176 | 2 | A-18 | 1.0 | Stable | 40 |
| 177 | 2 | A-18 | 2.0 | Stable | 40 |
| 178 | 2 | A-11 | 0.5 | Stable | 70 |
| 179 | 2 | A-11 | 1.0 | Stable | 70 |
| 180 | 2 | A-11 | 2.0 | Stable | 60 |
| 181 | 2 | A-36 | 1.0 | Stable | 90 |
| 182 | 2 | A-36 | 2.0 | Stable | 180 |
| 183 | 2 | A-37 | 2.0 | Stable | 1380 |
| 184 | 2 | A-38 | 1.0 | Stable | 125 |
| 185 | 2 | A-39 | 2.0 | Stable | 310 |
| 186 | 2 | A-21 | 0.5 | Stable | 100 |
| 187 | 2 | A-21 | 1.0 | Stable | 150 |
| 188 | 2 | A-21 | 2.0 | Stable | 1280 |
| 189 | 2 | A-20 | 0.5 | Stable | 75 |
| 190 | 2 | A-20 | 1.0 | Stable | 220 |
| 191 | 2 | A-20 | 2.0 | Stable | 6580 |
| 192 | 2 | A-19 | 0.5 | Stable | 940 |
| 193 | 2 | A-19 | 1.0 | Stable | 530 |
| 194 | 2 | A-19 | 2.0 | Stable | 4290 |
| 195 | 2 | A-23 | 0.5 | Stable | 1090 |
| 196 | 2 | A-23 | 1.0 | Stable | 1170 |
| 197 | 2 | A-23 | 2.0 | Stable | 4920 |
| 198 | 2 | A-40 | 0.5 | Stable | 190 |
| 199 | 2 | A-40 | 1.0 | Stable | 430 |
| 200 | 2 | A-40 | 2.0 | Stable | 4700 |
| 201 | 2 | A-41 | 1.0 | Stable | 300 |
| 202 | 2 | A-41 | 2.0 | Stable | 1580 |
| 203 | 2 | A-42 | 1.0 | Stable | 120 |
| 204 | 2 | A-42 | 2.0 | Stable | 350 |
| 205 | 2 | A-43 | 2.0 | Stable | 4150 |
| 206 | 46–48 | — | — | Unstable | 4000–6000* |
| 207 | 46 | A-11 | 0.5 | Stable | 90 |
| 208 | 46 | A-11 | 1.0 | Stable | 110 |
| 209 | 47 | A-11 | 1.0 | Stable | 620 |
| 210 | 48 | A-11 | 1.0 | Stable | 2230 |
| 211 | 38 | — | — | Unstable | 5000–6000* |
| 212 | 38 | A-11 | 1.0 | Stable | 560 |
| 213 | 38 | A-18 | 0.5 | Stable | 460 |
| 214 | 38 | A-18 | 1.0 | Stable | 510 |
| 215 | 38 | A-19 | 0.3 | Stable | 1240 |
| 216 | 38 | A-19 | 0.5 | Stable | 1040 |
| 217 | 38 | A-19 | 1.0 | Stable | 3230 |
| 218 | 38 | A-21 | 0.5 | Stable | 670 |
| 219 | 38 | A-21 | 1.0 | Stable | 1260 |
| 220 | 50 | A-11 | 0.75 | Stable | 730 |
| 221 | 49 | A-11 | 0.5 | Stable | 1510 |
| 222 | 49 | A-11 | 0.75 | Stable | 770 |
| 223 | 49 | A-11 | 1.0 | Stable | 730 |
| 224 | 49 | A-45 | 0.75 | Stable | 820 |
| 225 | 49 | A-21 | 0.75 | Stable | 1060 |
| 226 | 49 | A-21 | 0.40 | Stable | 2510 |
| 227 | 49 | A-17 | 0.75 | Stable | 880 |
| 228 | 49 | A-17 | 1.50 | Stable | 1510 |
| 229 | 49 | A-36 | 0.75 | Stable | 680 |
| 230 | 49 | A-44 | 0.75 | Stable | 680 |
| 231 | 49 | A-24 | 0.75 | Stable | 540 |
| 232 | 49–55 | — | — | Unstable | 4000–6000* |
| 233 | 51 | A-11 | 0.75 | Stable | 800 |
| 234 | 52 | A-11 | 0.75 | Stable | 650 |
| 235 | 53 | A-11 | 0.75 | Stable | 680 |
| 236 | 54 | A-11 | 0.75 | Stable | 790 |
| 237 | 55 | A-11 | 0.65 | Stable | 600 |
| 238 | 56–57 | — | — | Unstable | Not measured |
| 239 | 56 | A-11 | 0.25 | Stable | 880 |
| 240 | 57 | A-11 | 0.25 | Stable | 550 |
| 241 | 58 | — | — | Unstable | 140 |
| 242 | 58 | A-11 | 0.5 | Stable | 1300 |

-continued

| Example | Basic Composition | Polymer Type | % | Product Stability | Viscosity m Pas at $21s^{-1}$ |
|---|---|---|---|---|---|
| 243 | 58 | A-11 | 2.0 | Stable | 2240 |
| 244 | 58 | A-36 | 0.5 | Stable | 230 |
| 245 | 58 | A-36 | 2.0 | Stable | 140 |
| 246 | 59 | — | — | Unstable | 80 |
| 247 | 59 | A-11 | 0.5 | Stable | 270 |
| 248 | 59 | A-11 | 2.0 | Stable | 1190 |
| 249 | 59 | A-36 | 0.5 | Stable | 70 |
| 250 | 59 | A-36 | 2.0 | Stable | 120 |
| 251 | 60 | — | — | Stable | 520 |
| 252 | 60 | A-36 | 0.5 | Stable | 380 |
| 253 | 60 | A-36 | 2.0 | Stable | 220 |
| 254 | 60 | A-36 | 4.0 | Stable | 210 |
| 255 | 61 | — | — | Unstable | 340 |
| 256 | 61 | A-11 | 0.5 | Stable | 780 |
| 257 | 61 | A-17 | 0.5 | Stable | 1370 |
| 258 | 61 | A-18 | 0.5 | Stable | 400 |
| 259 | 62 | — | — | Unstable | 4000–6000* |
| 260 | 62 | A-11 | 0.5 | Stable | 940 |
| 261 | 63 | A-11 | 0.5 | Stable | 740 |
| 262 | 2 | B-1 | 2.0 | Stable | 100 |
| 263 | 2 | B-1 | 4.0 | Stable | 360 |
| 264 | 2 | B-10 | 2.0 | Stable | 1490 |
| 265 | 5 | B-11 | 2.0 | Stable | 50 |
| 266 | 2 | B-22 | 2.0 | Stable | 200 |
| 267 | 2 | B-23 | 2.0 | Stable | 140 |
| 268 | 2 | B-24 | 2.0 | Stable | 200 |
| 269 | 5 | B-25 | 2.0 | Stable | 1790 |
| 270 | 64–91 | — | — | Unstable | 4000–6000* |
| 271 | 64 | A-11 | 1.0 | Stable | 190 |
| 272 | 65 | A-11 | 1.0 | Stable | 2290 |
| 273 | 66 | A-11 | 1.0 | Stable | 850 |
| 274 | 67 | A-11 | 1.0 | Stable | 230 |
| 275 | 68 | A-11 | 1.0 | Stable | 440 |
| 276 | 69 | A-11 | 1.0 | Stable | 1130 |
| 277 | 70 | A-11 | 1.0 | Stable | 230 |
| 278 | 71 | A-11 | 1.0 | Stable | 190 |
| 279 | 72 | A-11 | 1.0 | Stable | 570 |
| 280 | 73 | A-11 | 1.0 | Stable | 370 |
| 281 | 74 | A-11 | 1.0 | Stable | 290 |
| 282 | 75 | A-11 | 1.0 | Stable | 600 |
| 283 | 76 | A-11 | 1.0 | Stable | 140 |
| 284 | 77 | A-11 | 1.0 | Stable | 700 |
| 285 | 78 | A-11 | 1.0 | Stable | 190 |
| 286 | 79 | A-11 | 1.0 | Stable | 260 |
| 287 | 80 | A-11 | 1.0 | Stable | 340 |
| 288 | 81 | A-11 | 1.0 | Stable | 250 |
| 289 | 82 | A-11 | 1.0 | Stable | 440 |
| 290 | 83 | A-11 | 1.0 | Stable | 480 |
| 291 | 84 | A-11 | 1.0 | Stable | 300 |
| 292 | 85 | A-11 | 1.0 | Stable | 160 |
| 293 | 86 | A-11 | 1.0 | Stable | 250 |
| 294 | 87 | A-11 | 1.0 | Stable | 240 |
| 295 | 88 | A-11 | 1.0 | Stable | 340 |
| 296 | 89 | A-11 | 1.0 | Stable | 360 |
| 297 | 90 | A-11 | 1.0 | Stable | 610 |
| 298 | 91 | A-11 | 1.0 | Stable | 190 |
| 299 | 92/93 | — | — | Unstable | 4000–6000* |
| 300 | 92 | A-11 | 1.0 | Stable | 1000 |
| 301 | 93 | A-11 | 1.0 | Stable | 220 |
| 302 | 5 | A-50 | 2.0 | Stable | 350 |

*Unreliable results due to rapid phase separation.
**Cannot be measured due to very rapid phase separation.
***After 11 days storage; product shows increase of viscosity due to stirring/shear.

Although not specified, similar results can be obtained with Deflocculating Polymers with structures A25–33, B2–9 and B12–21

TABLE 3

| Component | Raw Material Specification: Specification |
|---|---|
| NaDoBS | Na Dodecyl Benzene Sulphonate |
| LES | Lauryl ether sulphate |
| Synperonic A7 | $C_{12-15}$ ethoxylatd alcohol, 7EO, ex ICI |
| Synperonic A3 | $C_{12-15}$ ethoxylted alcohol, 3EO ex ICI |
| STP | Sodium Tripolyphosphate |
| KTP | Potassium Tripolyphosphate |

TABLE 3-continued

| Component | Raw Material Specification: Specification |
|---|---|
| Silicone oil | Foam depressor, ex Dow Corning |
| Gasil 200 | Corrosion inhibitor, ex Crossfield |
| Na-SCMC | Na Carboxymethyl cellulose (Anti-redeposition agent) |
| Tinopal CBS-X | Fluorescer, ex Ciba-Geigy |
| Blankophor RKH 766 | Fluorescer, ex Bayer |
| Dequest 2060S/2066 | Metal chelating agent, ex Monsanto |
| Alcalase 2.5 L | Proteolitic enzyme, ex Novo |
| Dobanol 23-6.5 | $C_{12-13}$ ethoxylated alcohol, 6.5 EO, ex Shell |
| Neodol 23-6.5 | as Dobanol 23-6.5 |
| TrEA | Triethanolamine |
| Zeolite A4 | Wessalith P, ex Degussa |
| Na-CMOS | Carboxy-Methyl-Oxy-Succinate, tri sodium salt |
| Sokalan CP5 | Acrylic/Maleic builder polymer, ex BASF |

We claim:

1. A liquid detergent composition comprising from 25% to 60% by weight of non-soap detergent active material and 1 to 60% by weight of electrolytes to form a dispersion of lamellar droplets in an aqueous continuous phase, the composition having a pH of less than 12.5 and yielding no more than 2% by volume phase separation when stored at 25° C. for 21 days from the time of preparation and further comprising from about 0.01 to about 5% by weight of a deflocculating polymer having a weight average molecular weight of from 500 to 500,000, wherein said deflocculating polymer comprises a combination of a hydrophillic backbone comprising monomer units selected from:

a) one or more ethylenically unsaturated hydrophillic monomers selected from the group consisting of unsaturated $C_{1-6}$ acids, ethers, alcohols, aldehydes, ketones or esters; and/or b) one or more polymerizable hydrophillic cyclic monomer units; and/or c) one or more non-ethylenically unsaturated polymerizable hydrophillic monomers selected from the group consisting of glycerol and other polyhydric alcohols;

wherein said polymer is optionally substituted with one or more amino, amine, amide, sulphonate, sulphate, phosphonate, hydroxy, carboxyl or oxide groups;

and at least one hydrophobic side chain comprising monomers selected from siloxanes, saturated or unsaturated alkyl and hydrophobic alkoxygroups, aryl and aryl-alkyl groups, and mixtures thereof;

with the proviso that said deflocculating polymer may not include partially esterified copolymers of maleic anhydride or substituted maleic anhydride.

2. A composition according to claim 1, wherein the polymer has the general formula (I)

(I)

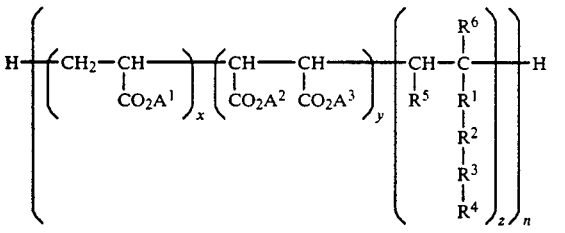

wherein:

z is 1; (x+y): z is from 4:1 to 1,000:1; in which the monomer units may be in random order; y being from 0 up to a maximum equal to the value of x; and n is at least 1;

$R^1$ represents —CO—O—, —O—, —O—CO—, —$CH_2$—, —CO—NH— or is absent;

$R^2$ represents from 1 to 50 independently selected alkyleneoxy groups, or is absent, provided that when $R^3$ is absent and $R^4$ represents hydrogen or contains no more than 4 carbon atoms, then $R^2$ must contain an alkyleneoxy group with at least 3 carbon atoms;

$R^3$ represents a phenylene linkage, or is absent;

$R^4$ represents hydrogen or a $C_{1-24}$ alkyl or $C_{2-24}$ alkenyl group, with the provisos that a) when $R^1$ represents —O—CO—, $R^2$ and $R^3$ must be absent and $R^4$ must contain at least 5 carbon atoms;

b) when $R^2$ is absent, $R^4$ is not hydrogen and when $R^3$ is absent, then $R^4$ must contain at least 5 carbon atoms;

$R^5$ represents hydrogen or a group of formula —$COOA^4$;

$R^6$ represents hydrogen or $C_{1-4}$ alkyl; and $A^1$, $A^2$, $A^3$ and $A^4$ are independently selected from hydrogen, alkali metals, alkaline earth metals, ammonium and amine bases and $C_{1-4}$ alkyl;

or of formula (II):

(II)

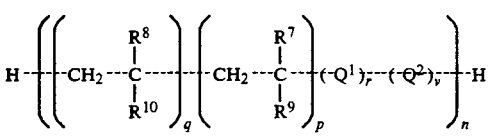

wherein:

$Q^2$ is a molecular entity of formula (IIa):

(IIa)

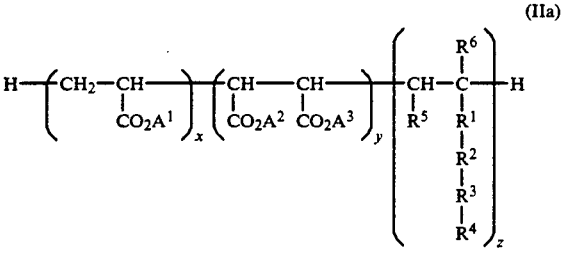

wherein z and $R^{1-6}$ are as defined for formula (I); $A^{1-4}$, are as defined for formula (I) or $(C_2H_4O)_tH$, wherein t is from 1-50, and wherein the monomer units may be in random order;

$Q^1$ is a multifunctional monomer, allowing the branching of the polymer, wherein the monomers of the polymer may be connected to $Q^1$ in any direction, in any order, therewith possibly resulting in a branched polymer;

n and z are as defined above; v=1 and (x+y+p+q+r): z is from 4:1 to 1,000:1, in which the monomer units may be in random order;

$R^7$ and $R^8$ represent —$CH_3$ or —H;

$R^9$ and $R^{10}$ represent independently selected groups selected from —$SO_3Na$, —CO—O—$C_2H_4$—$OSO_3Na$, —CO—O—NH—$C(CH_3)_2$—$SO_3Na$, —CO—$NH_2$, —O—CO—$CH_3$, —OH;

3. A composition according to claim 1, wherein the polymer is of formula III:

(III)

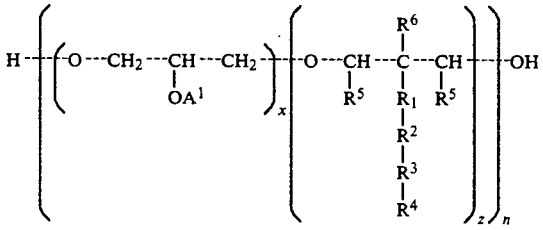

wherein:

x is from 4 to 1,000, n, z and $R^{1-6}$ are as defined in formula I, wherein the monomers units may be in random order;

$A^1$ is as defined above for formula I, or —CO—$CH_2$—C(OH)—$CO_2A^1$—$CH_2$—$CO_2A^1$, or may be a branching point whereto other molecules of formula (III) are attached.

4. A composition according to claim 1, wherein the polymer has the formula VI:

(VI)

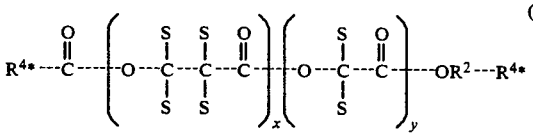

wherein:

If z is the total of $R^4$ groups, then the ratio (x+y): z is from 4:1 to 1,000:1,; $R^{4*}$ is $R^4$ or —H;

$R^2$ and $R^4$ are as defined above for formula I;

and S is selected from —H, —$COOA^1$, —$CH_2COOA^1$, —$CH(COOA^1)_2$, $(CH_2COOA^1)_2H$, wherein $A^1$ is as defined for formula I or is $R^4$;

with the proviso that at least one $R^4$ group is present as a side chain;

or of formula (VII):

(VII)

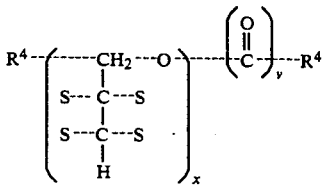

Wherein:

x, z, S and $R^4$ are as defined above for formula VI; and wherein at least one $R^4$ group is present as a side chain; v is 0 or 1.

5. A composition according to claim 1, wherein the average molecular weight of the polymer is from 500 to 500,000 as determined by gel permeation chromatography, using polyacrylate standards.

6. A composition according to claim 1, wherein the total amount of deflocculating polymer is from 0.01 to 5% by weight of the total composition.

7. A composition according to any of claim 1, wherein the deflocculating polymer has a specific viscosity less than 0.1 (1 g in 100 ml methylethylketone at 25° C.).

8. A composition according to claim 1 having a pH less than 11.

9. A composition according to claim 1, containing solid particles in suspension.

10. A composition according to claim 1, which yields less than 0.1% by volume visible phase separation after storage at 25° C. for 90 days from the time of preparation.

11. A composition according to claim 1, comprising at least 30% by weight of detergent active material.

12. A composition according to claim 1, having a viscosity of no greater than 1 Pas at a shear rate of $21s^{-1}$.

13. A composition according to claim 1 comprising less than 45% by weight of water.

14. A composition according to claim 1, wherein the polymer is of the formula (IV)

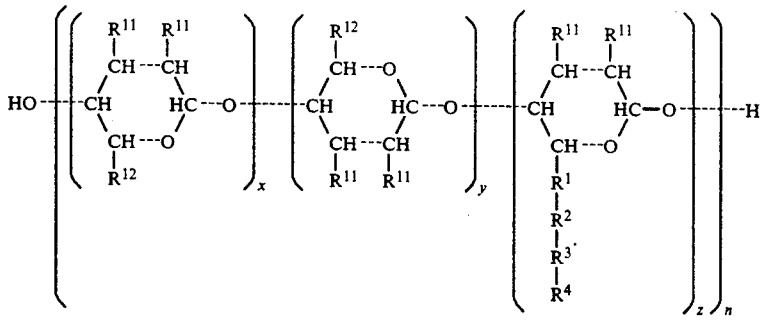

(IV)

wherein:

z, n and $A^1$ are as defined above for formula I; (x+y):z is from 4:1 to 1,000:1, wherein the monomers may be in random order;

$R^1$ is as defined above for formula I, or can be $—CH_2—O—$, $—CH_2—O—CO—$, $—NH—CO—$;

$R^{2-4}$ are as defined in formula I;

$R^{11}$ represents —OH, $—NH—CO—CH_3$, or $—OSO_3A^1$;

R12 represents —OH, $—CH_2OH$, $—CH_2OSO_3A^1$, $COOA^1$, $—CH_2—OCH3$;

or of formula (V):

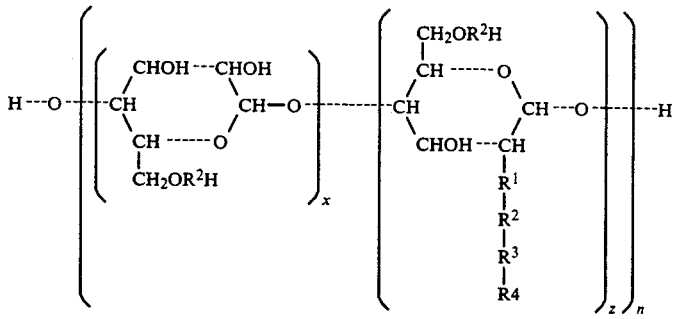

(V)

wherein: z, n and $R^{1-6}$ are defined above for formula I; and x is as defined for formula III.

15. A composition according to claim 1, wherein the $C_{1-6}$ compound is a monomer selected from the group of monomers consisting of acrylic acid, methacrylic acid, maleic acid, crotonic acid itaconic acid, aconitic acid, citraconic acid, vinyl-methyl ether, vinyl sulphonate, vinylalcohol obtained by the hydrolysis of vinyl acetate, acrolein, alkyl alcohol and vinyl acetic acid.

* * * * *